US007466311B2

(12) United States Patent
Kasai

(10) Patent No.: US 7,466,311 B2
(45) **Date of Patent: *Dec. 16, 2008**

(54) DRIVING OF DATA LINES USED IN UNIT CIRCUIT CONTROL

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 443 days.

This patent is subject to a terminal disclaimer.

(21) Appl. No.: 11/272,968

(22) Filed: Nov. 15, 2005

(65) Prior Publication Data

US 2006/0114192 A1 Jun. 1, 2006

Related U.S. Application Data

(63) Continuation of application No. 10/207,091, filed on Jul. 30, 2002, now Pat. No. 6,989,826.

(30) Foreign Application Priority Data

Aug. 2, 2001 (JP) ..... 2001-235387
Dec. 3, 2001 (JP) ..... 2001-368399

(51) Int. Cl.
*G09G 5/00* (2006.01)
*G09G 3/32* (2006.01)

(52) U.S. Cl. ..... 345/204; 345/76; 345/82; 345/92; 315/169.1; 315/169.3

(58) Field of Classification Search ..... 345/48, 345/55, 76, 82, 87, 90, 92, 204, 211; 315/169.1–169.4
See application file for complete search history.

(56) References Cited

U.S. PATENT DOCUMENTS 4,366,504 A 12/1982 Kanatani (Continued)

FOREIGN PATENT DOCUMENTS

CN 1217806 A 5/1999

(Continued)

OTHER PUBLICATIONS

Inukai, Kazutaka et al., "4.0-in. TFT-OLED Displays and a Novel Digital Driving Method," 2000 SID International Symposium Digest of Technical Papers, Long Beach, CA, May 16-18, 2000, SID International Symposium Digest of Technical Papers, San Jose, CA: vol. 31, May 16, 2000, pp. 924-927.

*Primary Examiner*—Henry N Tran
(74) *Attorney, Agent, or Firm*—Oliff & Berridge, PLC

(57) ABSTRACT

The display matrix section 200 has pixel circuits 210 arranged in the form of a matrix, a plurality of gate lines Y1, Y2 . . . that extend in the row direction, and a plurality of data lines X1, X2 . . . that extend in the column direction. The scan lines are connected to a gate driver 300, and the data lines are connected to a data line driver 400. A pre-charging circuit 600 or additional current generation circuit is installed for each data line as means for accelerating the charging or discharging of the data line. For each data line, charging or discharging is accelerated by pre-charging or current addition prior to the completion of the setting of the light emission level in the corresponding pixel circuit 210.

9 Claims, 30 Drawing Sheets

U.S. PATENT DOCUMENTS

| | | | | |
|---|---|---|---|---|
| 5,552,677 | A | 9/1996 | Pagones | 315/169.1 |
| 5,684,368 | A | 11/1997 | Wei et al. | |
| 5,686,936 | A | 11/1997 | Maekawa et al. | 345/100 |
| 5,723,950 | A | 3/1998 | Wei et al. | 315/169.3 |
| 6,195,076 | B1 | 2/2001 | Sakuragi et al. | |
| 6,229,506 | B1 | 5/2001 | Dawson et al. | |
| 6,229,508 | B1 | 5/2001 | Kane | |
| 6,246,180 | B1 | 6/2001 | Nishigaki | |
| 6,356,253 | B2 | 3/2002 | Uchino et al. | 345/89 |
| 6,462,722 | B1 | 10/2002 | Kimura et al. | |
| 6,473,064 | B1 | 10/2002 | Tsuchida et al. | |
| 6,531,827 | B2 | 3/2003 | Kawashima | |
| 6,618,030 | B2 | 9/2003 | Kane et al. | |
| 6,753,654 | B2 | 6/2004 | Koyama | |
| 6,778,154 | B2 | 8/2004 | Van Veizen | 345/76 |
| 6,847,344 | B2 | 1/2005 | Ha | 345/95 |
| 6,859,193 | B1 | 2/2005 | Yumoto | |
| 6,943,500 | B2 * | 9/2005 | LeChevalier | 315/169.3 |
| 6,947,019 | B2 | 9/2005 | Sato et al. | |
| 6,963,321 | B2 * | 11/2005 | Everitt | 345/82 |
| 6,995,737 | B2 * | 2/2006 | LeChevalier | 345/82 |
| 7,106,281 | B2 * | 9/2006 | Kim et al. | 345/76 |
| 7,126,568 | B2 * | 10/2006 | LeChevalier | 345/84 |
| 2003/0128200 | A1 | 7/2003 | Yumoto | |

FOREIGN PATENT DOCUMENTS

| | | | |
|---|---|---|---|
| CN | 1242563 | A | 1/2001 |
| EP | 1 071 070 | A2 | 1/2001 |
| JP | A 7-295520 | | 11/1995 |
| JP | A-9-319327 | | 12/1997 |
| JP | A 11-45071 | | 2/1999 |
| JP | A-11-219146 | | 8/1999 |
| JP | A 11-231834 | | 8/1999 |
| JP | A 11-311970 | | 11/1999 |
| JP | A 2000-138572 | | 5/2000 |
| JP | A 2000-221942 | | 8/2000 |
| JP | A 2000-250471 | | 9/2000 |
| JP | A 2001-296837 | | 10/2001 |
| JP | A 2002-55654 | | 2/2002 |
| JP | A 2002-287697 | | 10/2002 |
| JP | A 2002-333862 | | 11/2002 |
| JP | A 2003-195815 | | 7/2003 |
| WO | WO 98/48403 | | 10/1998 |
| WO | WO 99/65011 | | 12/1999 |
| WO | WO 01/06484 | A1 | 1/2001 |
| WO | WO 01/29813 | A1 | 4/2001 |

* cited by examiner

Tpr
V1

Ip
Im
Iout

Qd
=Vd·Cd
Qdm
with additional current
without additional current
Qd0
t1
t2
t3
t4
Qd0 small ⟷ previous Im large
Qdm large ⟷ present Im small Tpr
V1

Ip
Im
Iout

Qd
=Vd·Cd
Qdm
with additional current
without additional current
Qd0
t1
t2
t3
t4
Qd0 small ⟷ previous Im small
Qdm large ⟷ present Im large

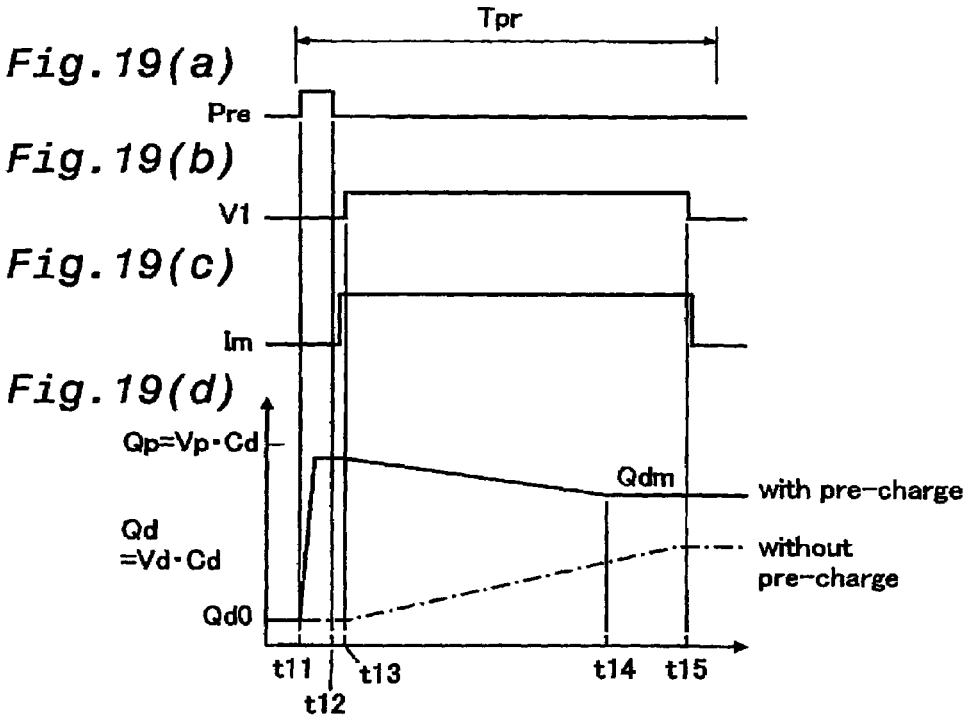
Fig.19(a)
Fig.19(b)
Fig.19(c)
Fig.19(d)
Tpr
Pre
V1
Im
Qp=Vp·Cd
Qd
=Vd·Cd
Qd0
Qdm
with pre-charge
without
pre-charge
t11
t12
t13
t14
t15
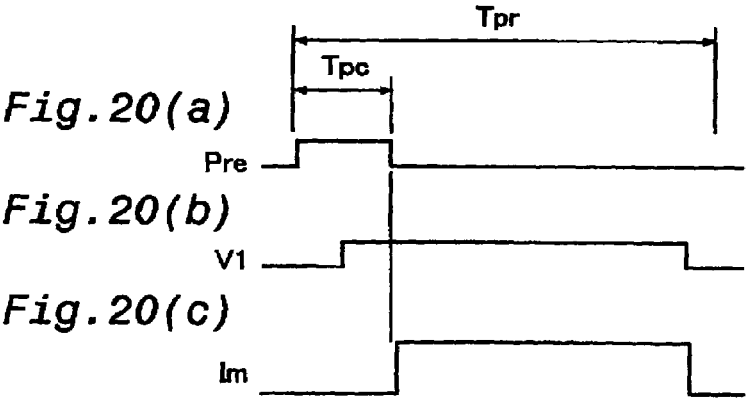
Fig.20(a)
Fig.20(b)
Fig.20(c)
Tpr
Tpc
Pre
V1
Im Tpr
Tpc Pre

V1

Im

DRIVING OF DATA LINES USED IN UNIT CIRCUIT CONTROL

This is a Continuation of application Ser. No. 10/207,091 filed Jul. 30, 2002. The entire disclosure of the prior application is hereby incorporated by reference herein in its entirety.

BACKGROUND OF THE INVENTION

1. Field of the Invention

The present invention relates to a technique for driving data lines used in control of unit circuits, such as pixel circuits of a display device.

2. Description of the Related Art

In recent years, electro-optical devices using organic EL elements (organic electroluminescent elements) have been under development. Organic EL elements emit light themselves, and do not require back lighting. Accordingly, it is expected that such elements will make it possible to achieve display devices that have a lower power consumption, high visual field angle and high contrast ratio. Furthermore, in the present specification, the term "electro-optical device" refers to a device that converts an electrical signal into light. A typical example of an electro-optical device is a device that converts an electrical signal expressing an image into light representing an image; such a device is especially suitable as a display device.

FIG. 1 is a block diagram which illustrates the general structure of a display device using organic EL elements. This display device has a display matrix section 120, a gate driver 130, and a data line driver 140. The display matrix section 120 has a plurality of pixel circuits 110 that are arranged in the form of a matrix, and an organic EL element 114 is disposed in each pixel circuit 110. A plurality of data lines X1, X2 . . . that extend along the column direction of the matrix, and a plurality of gate lines Y1, Y2 . . . that extend along the row direction of the matrix, are respectively connected to the matrix of the pixel circuits 110.

In cases where a large display panel is constructed using the configuration shown in FIG. 1, the electrostatic capacitance Cd of each data line is fairly large. When the electrostatic capacitance Cd of the data lines is large, considerable time is required to drive the data lines. It has been very difficult to construct a large display panel using organic EL elements because the large number of organic EL elements require very high driving speed.

The above mentioned problem is not limited to display devices using organic EL elements, but is also common to display devices and electro-optical devices using current-driven light-emitting elements other than organic EL elements. Furthermore, this problem is not limited to light-emitting elements, but is also common to general electronic devices using current-driven elements that are driven by an electric current.

SUMMARY OF THE INVENTION

Accordingly, an object of the present invention to shorten the driving time of data lines used in unit circuits.

In order to attain the above and other related objects of the present invention, there is provided an electro-optical device which is driven by an active matrix driving method. The electro-optical device comprises: a unit circuit matrix in which a plurality of unit circuits each having a light-emitting element and a circuit for adjusting an emission level of light to be emitted by the light-emitting element are arranged in the form of a matrix; a plurality of scan lines which are respectively connected to the unit circuits, and which are arranged along a row direction of the unit circuit matrix; a plurality of data lines which are respectively connected to the unit circuits, and which are arranged along a column direction of the unit circuit matrix; a scan line driving circuit, connected to the plurality of scan lines, for selecting one row of the unit circuit matrix; a data signal generating circuit for generating a data signal in accordance with the emission level of the light to be emitted by the light-emitting element, and outputting the data signal onto at least one data line among the plurality of data lines; and a charging/discharging accelerating section which is capable of accelerating charging or discharging of a data line through which the data signal is supplied to at least one unit circuit that is present in the row selected by the scan line driving circuit.

In one embodiment of the present invention, the charging/discharging accelerating section includes a pre-charging circuit that is capable of pre-charging the plurality of data lines. The charging/discharging accelerating section may include an additional current generation circuit for adding a current value to a current value of the data signal that corresponds to the emission level of the light to be emitted by the light-emitting element.

According to another aspect of the present invention, an electronic device comprises: a plurality of current-driven elements whose operation is controlled according to a current value of the current flowing through the element; data lines for supplying a data signal that defines an operating state of a current-driven element; a data signal generating circuit for outputting the data signal to the data lines; and a charging/discharging accelerating section configured to accelerate charging or discharging of a data line through which the data signal is supplied to the current-driven element.

The present invention is also directed to an electro-optical device comprising: a current generating circuit for generating a current in response to an input signal; unit circuits each including an electro-optical element; data lines for supplying a current to each unit circuit; and accelerating means for accelerating variation in the current which is to be caused by variation in the input signal.

In one embodiment, an electro-optical device includes a current generating circuit for generating a current in response to an input signal; unit circuits each including an electro-optical element; and data lines for supplying a current to each unit circuit. The electro-optical device is driven by causing a current value of the current to vary from a first current value to a second current value in response to variation in the input signal through a plurality of periods with different rates of variation in the current value over time.

The present invention is further directed to an electro-optical device comprising: a current generating circuit for generating a current in response to an input signal; unit circuits each including an electro-optical element; data lines for supplying a current to each unit circuit; and resetting means for resetting charges of a data line when the current on the data line is varied in response to the input signal.

These and other objects, features, aspects, and advantages of the present invention will become more apparent from the following detailed description of the preferred embodiments with the accompanying drawings.

BRIEF DESCRIPTION OF THE DRAWINGS

FIGS. 19(*a*)-19(*d*) are explanatory diagrams which show the operation of the programming period in the fourth embodiment.

FIGS. 20(*a*)-20(*c*) are explanatory diagrams which illustrate a modification of the pre-charging period.

DESCRIPTION OF THE PREFERRED EMBODIMENT

Preferred embodiments of the present invention will be described in the following order:

A. First Embodiment (Current Addition 1)
B. Second Embodiment (Current Addition 2)
C. Third Embodiment (Current Addition 3)
D. Modifications Utilizing Current Addition
E. Fourth Embodiment (Pre-Charging)
F. Modifications Relating to Timing of Pre-Charging
G. Modifications Relating to Disposition of Pre-Charging Circuit
H. Examples of Application to Electronic Equipment
I. Other Modifications

A. First Embodiment (Current Addition 1)

Figure 1:
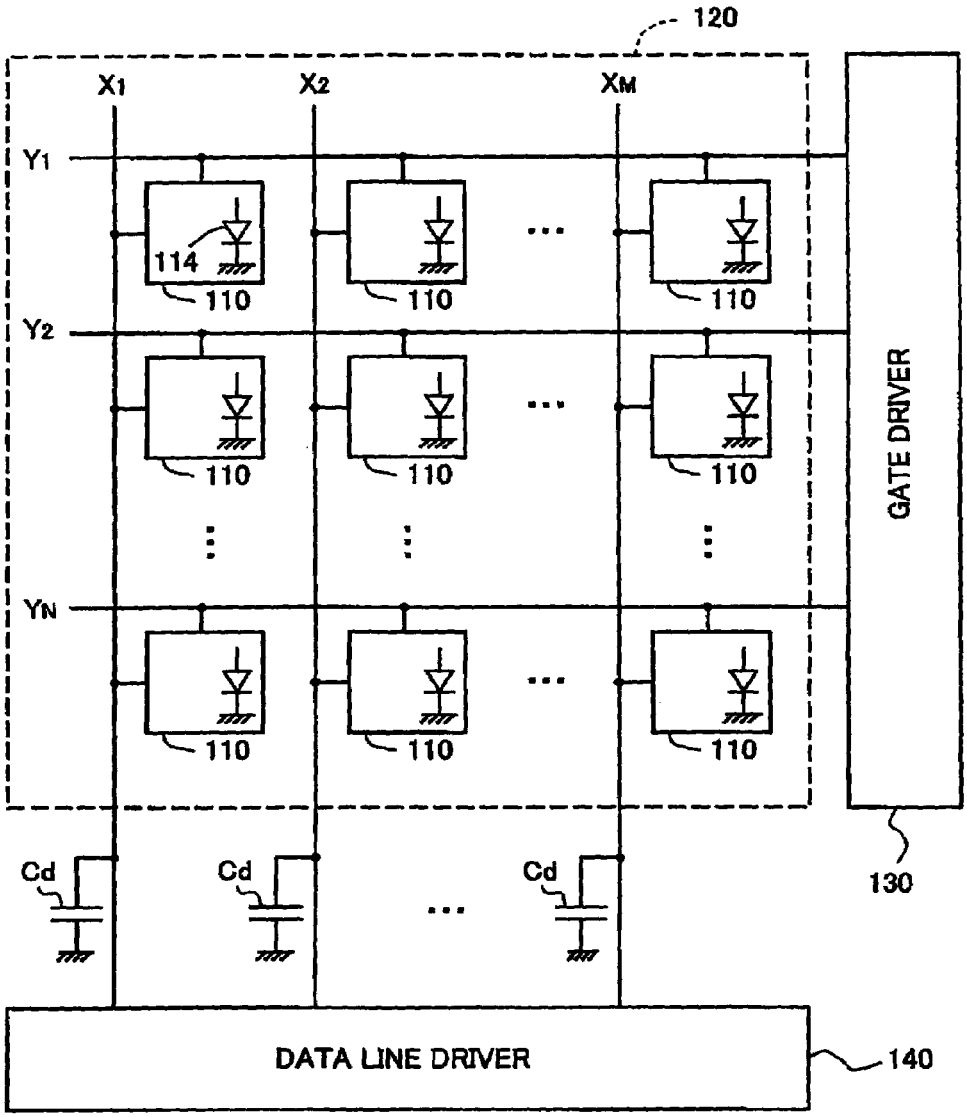
FIG. 1 is a block diagram which shows the general structure of a display device using organic EL elements.
Figure 2:
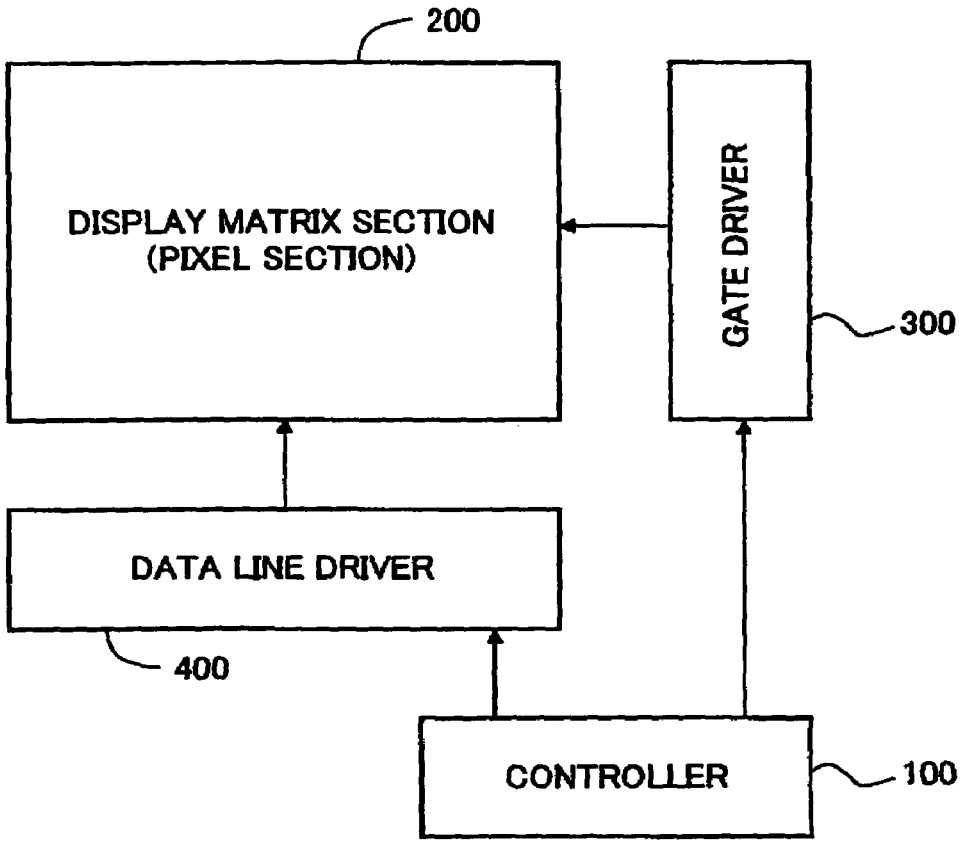
FIG. 2 is a block diagram which shows the structure of a display device as one embodiment of the present invention.

FIG. 2 is a block diagram which shows the schematic structure of a display device as a first embodiment of the present invention. This display device has a controller 100, a display matrix section 200 (also called a "pixel section"), a gate driver 300, and a data line driver 400. The controller 100 generates gate driving signals and data line driving signals that are used to perform displays on the display matrix section 200, and respectively supplies these signals to the gate driver 300 and data line driver 400.

Figure 3:
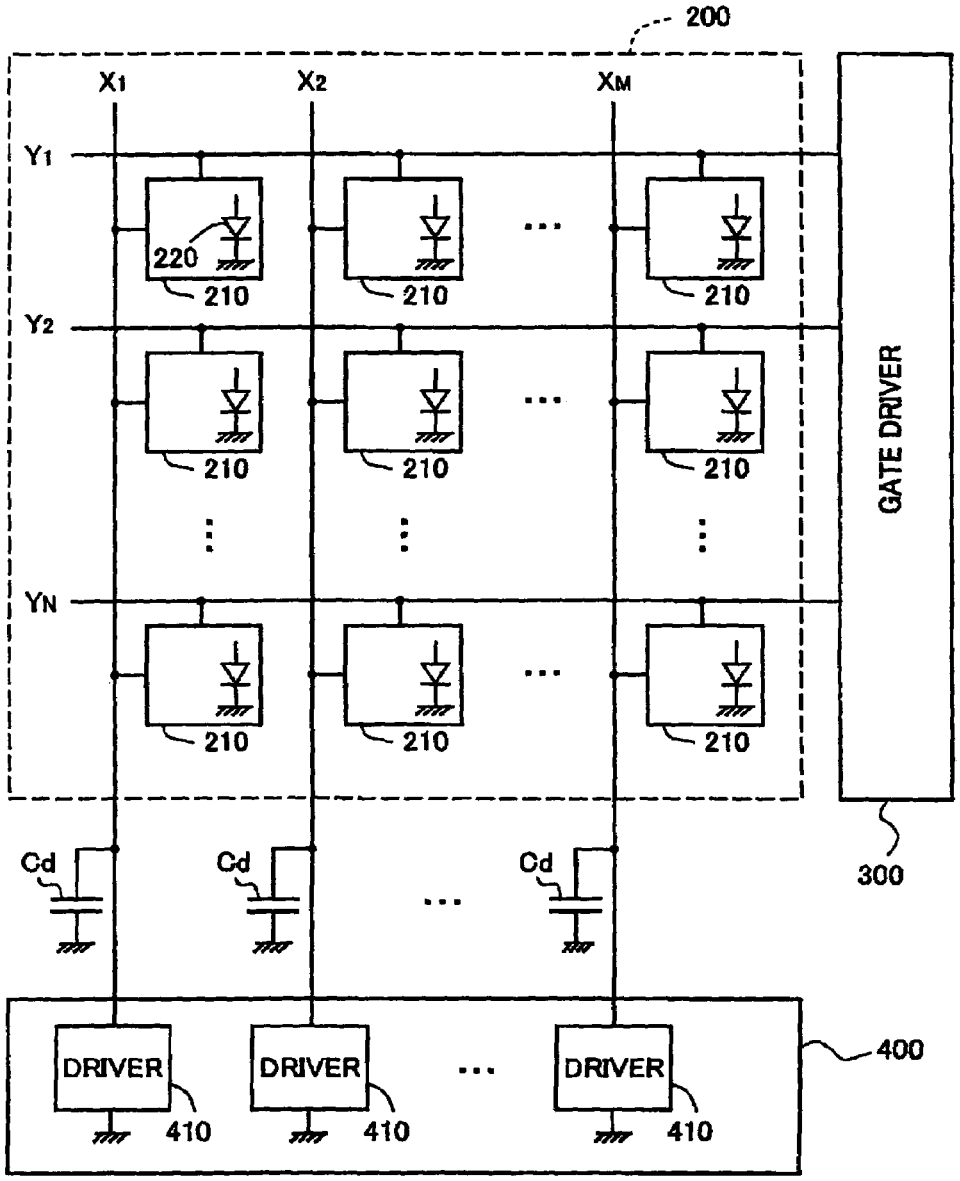
FIG. 3 is a block diagram which shows the internal structure of the display matrix section 200 and data line driver 400.

FIG. 3 shows the internal structure of the display matrix section 200 and data line driver 400. The display matrix section 200 has a plurality of pixel circuits 210 that are arranged in the form of a matrix, and each of these pixel circuits 210 has an organic EL element 220. There are provided a plurality of data lines Xm (m=1 through M) that extend along the column direction of the matrix, and a plurality of gate lines Yn (n=1 through N) that extend along the row direction of the matrix, and they are respectively connected to the matrix of the pixel circuits 210. The data lines are also referred to as "source lines", and the gate lines are also referred to as "scan lines". Furthermore, in the present specification, the pixel circuits 210 are also referred to as "unit circuits" or "pixels." The transistors inside the pixel circuits 210 are typically constructed as Thin Film Transistors.

The gate driver 300 selectively drives one of the plurality of gate lines Yn, and selects one row of pixel circuits. The data line driver 400 has a plurality of single-line drivers 410 that are used to drive the respective data lines Xm. These single-line drivers 410 supply data signals to the pixel circuits 210 via the respective data lines Xm. When the internal functions (described later) of the pixel circuits 210 are set in accordance with these data signals, the current values that flow through the organic EL elements 220 are controlled in accordance with these settings; as a result, the emission level of the light emitted by the organic EL elements 220 is controlled.

The controller 100 (FIG. 2) converts display data (image data) that represents a display state of the pixel region 220 into matrix data that expresses the emission levels of the light emitted by the respective organic EL elements 220. This matrix data includes gate line driving signals that are used for the successive selection of one row of pixel circuits, and data line driving signals that indicate the levels of the data line signals that are supplied to the organic EL elements in the selected row of pixel circuits. The gate line driving signals and data line driving signals are respectively supplied to the gate driver 300 and data line drive 400. The controller 100 also controls the timing of the driving of the gate lines and data lines.

Figure 4:
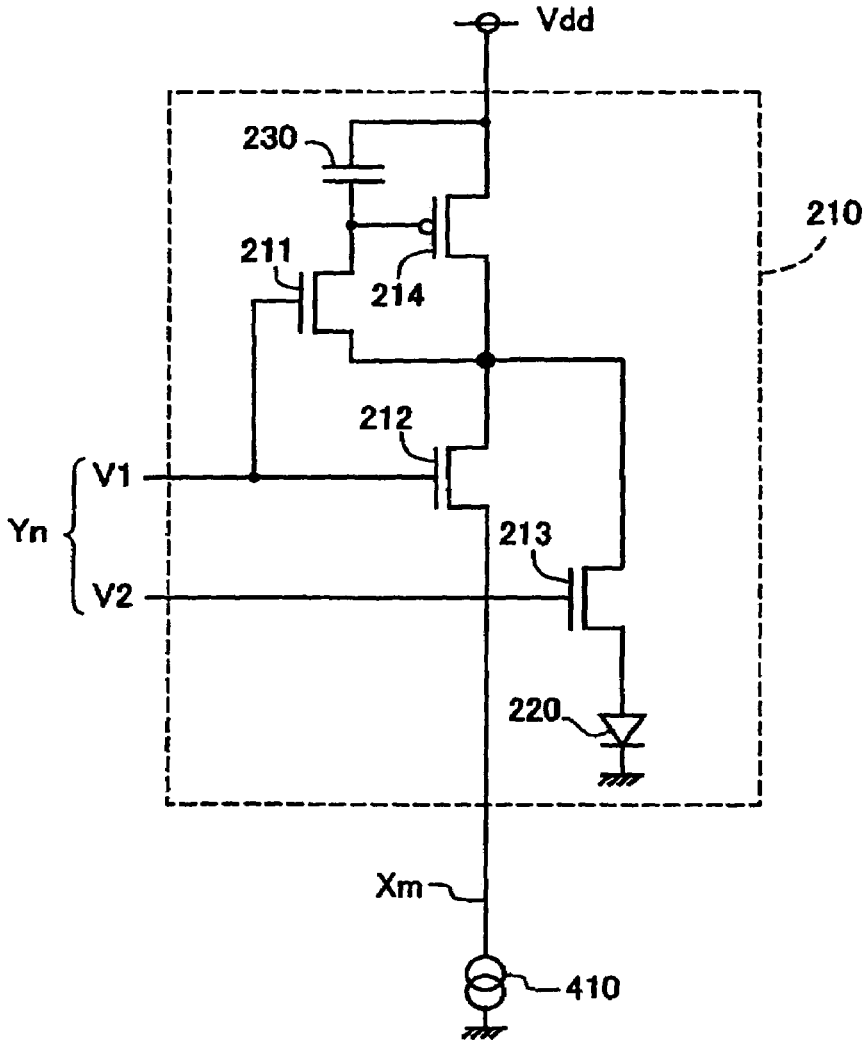
FIG. 4 is a circuit diagram which shows the internal structure of a pixel circuit 210 in the first embodiment.

FIG. 4 is a circuit diagram which shows the internal structure of a pixel circuit 210. This pixel circuit 210 is disposed at the intersection point of the m-th data line Xm and n-th gate line Yn. The gate line Yn includes two sub-gate lines V1 and V2 in this embodiment.

The pixel circuit 210 is a current-program type circuit that adjusts the emission level of the organic EL element 220 in accordance with the current value that flows through the data line Xm. In concrete terms, this pixel circuit 210 has four transistors 211 through 214 and a storage capacitor 230 (also called a "memory capacitor") in addition to the organic EL element 220. The storage capacitor 230 holds an electric charge corresponding to a current of the data signal that is supplied via the data line Xm. In this way, the storage capacitor is used to adjust the emission level of the light emitted by the organic EL element 220. Specifically, the storage capacitor 230 corresponds to a voltage holding means for holding a voltage that corresponds to the current that flows through the data line Xm. The first through third transistors 211 through 213 are n-channel type FETs, and the fourth transistor 214 is a p-channel type FET. The organic EL element 220 is a current injection type (current-driven type) light-emitting element similar to a photodiode; accordingly, this element is indicated by a diode symbol here.

The source of the first transistor 211 is connected to the drain of the second transistor 212, the drain of the third transistor 213, and the drain of the fourth transistor 214. The drain of the first transistor 211 is connected to the gate of the fourth transistor 214. The storage capacitor 230 is coupled between the source and gate of the fourth transistor 214. The source of the fourth transistor is also connected to the power supply voltage Vdd.

The source of the second transistor 212 is connected to the single-line driver 410 (FIG. 3) via the data line Xm. The organic EL element 22 is connected between the source of the third transistor 213 and the ground voltage.

The gates of the first and second transistors 211 and 212 are connected in common to the first sub-gate line V1. The gate of the third transistor 213 is connected to the second sub-gate line V2.

The first and second transistors 211 and 212 are switching transistors that are used in accumulating charges into the storage capacitor 230. The third transistor 213 is a switching transistor that is maintained in an "on" state during the light emission period of the organic EL element 220. The fourth transistor 214 is a driving transistor that is used to adjust the current value that flows through the organic EL element 220. The current value of the fourth transistor 214 is controlled by the charge quantity (accumulated charge quantity) that is held in the storage capacitor 230.

Figures 5A, 5B, 5C, 5D:
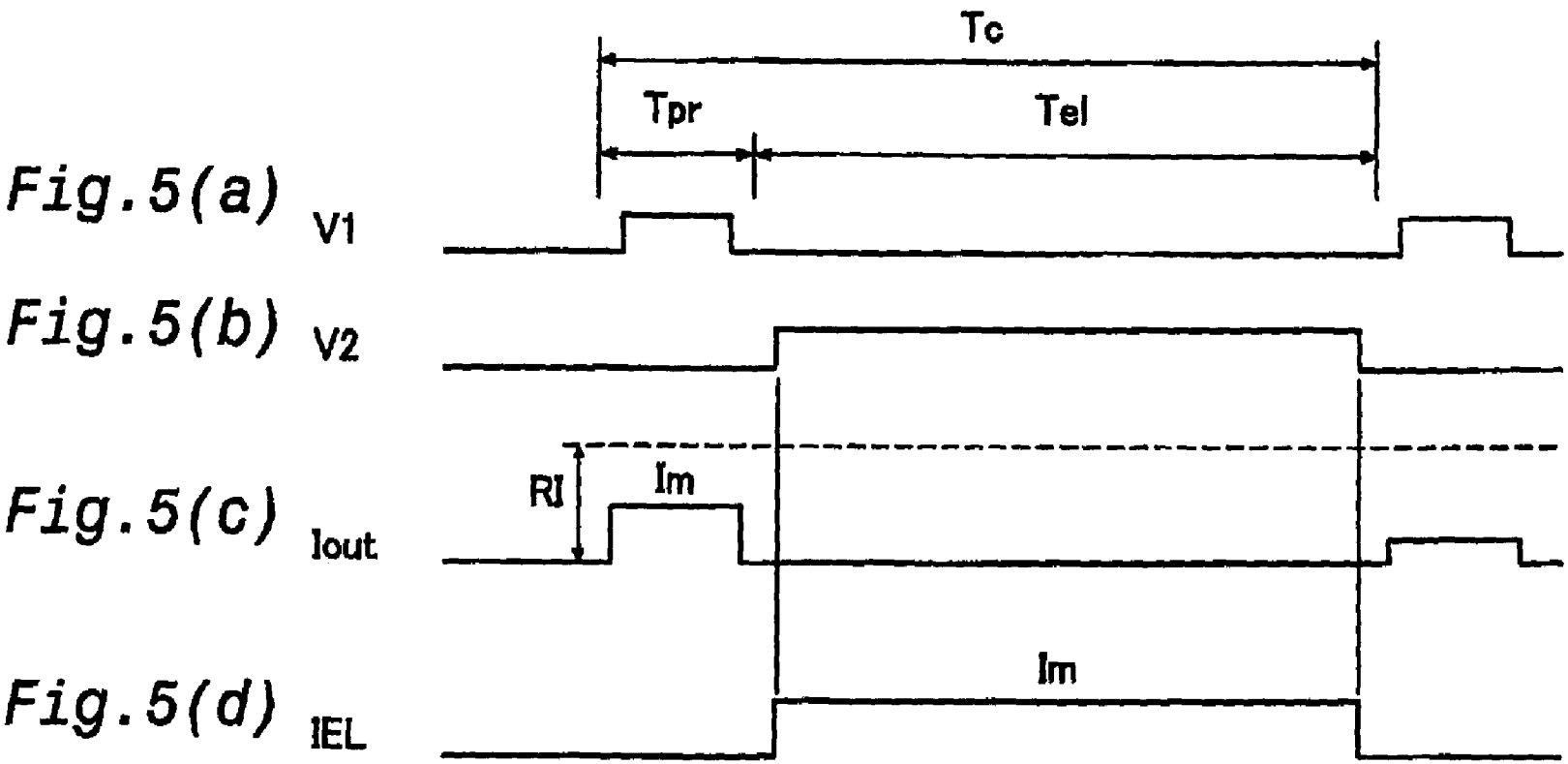
FIGS. 5(*a*)-5(*d*) are timing charts which show the ordinary operation of a pixel circuit 210 in the first embodiment.

FIGS. 5(*a*)-5(*d*) are timing charts showing the ordinary operation of the pixel circuit 210. There are shown the voltage level of the first sub-gate line V1 (hereafter also referred to as the "first gate signal V1"), the voltage level of the second sub-gate line V2 (hereafter also referred to as the "second gate signal V2"), the current value Iout of the data line Xm (hereafter also referred to as the data signal Iout"), and the current value IEL that flows through the organic EL element 220.

The driving period Tc is divided into a programming period Tpr and a light emission period Tel. Here, the "driving period Tc" refers to a period in which the light emission levels, or gradation levels, of all of the organic EL elements 220 in the display matrix section 200 are updated one at a time, and is the same as a so-called "frame period". The updating of emission levels is performed for each row of pixel circuits; the emission levels of N rows of pixel circuits are successively updated during the driving period Tc. For example, in a case where the emission levels of all of the pixel circuits are updated at 30 Hz, the driving period is approximately 33 ms.

The programming period Tpr is a period in which the light emission levels of the organic EL elements 220 are set inside the pixel circuits 210. In the present specification, the setting of the emission levels in the pixel circuits 210 is called "programming". For example, in a case where the driving period Tc is approximately 33 ms, and the total number N of gate lines Yn is 480 lines, the programming period Tpr is about 69 □s (=33 ms/480) or less.

In the programming period Tpr, the second gate signal V2 is first set at the L level, and the third transistor 213 is maintained in an "off" state. Next, while a current value Im that corresponds to the light emission level is caused to flow through the data line Xm, the first gate signal V1 is set at the H level, and the first and second transistors 211 and 212 are switched to an "on" state. The single-line driver 410 (FIG. 4) of this data line Xm functions as a constant current source that causes a constant current value Im corresponding to the light emission level to flow. As is shown in FIG. 5(*c*), this current value Im is set at a value that corresponds to the light emission level of the organic EL element 220 within a specified current value range RI.

Accordingly, the storage capacitor 230 is to hold a charge corresponding to the current value Im that flows through the fourth transistor 214 (driving transistor). As a result, the voltage stored in the storage capacitor 230 is applied across the source and gate of the fourth transistor 214. In the present specification, the current values Im of the data signals used in the programming operation are called "programming current values Im".

When the programming is completed, the gate driver 300 sets the gate signal V1 at the L level, and switches the first and second transistors 211 and 212 to an "off" state; furthermore, the data line driver 400 stops the data signal Iout.

In the light emission period Tel, the second gate signal V2 is set at the H level to put the third transistor 213 in an "on" state while the first gate signal V1 is maintained at the L level to put the first and second transistors 211 and 212 in an "off" state. Since a voltage that corresponds to the programming current value Im has been stored beforehand in the storage capacitor 230, a current that is about the same as the programming current value Im flows through the fourth transistor 214. Accordingly, a current that is about the same as the programming current value Im also flows through the organic EL element 220, so that light is emitted at a specific level that corresponds to this current value Im. A pixel circuit 210 of the type in which the voltage (i.e., charge) of the storage capacitor 230 is written by the current value Im is called a "current-programmable circuit".

Figure 6:
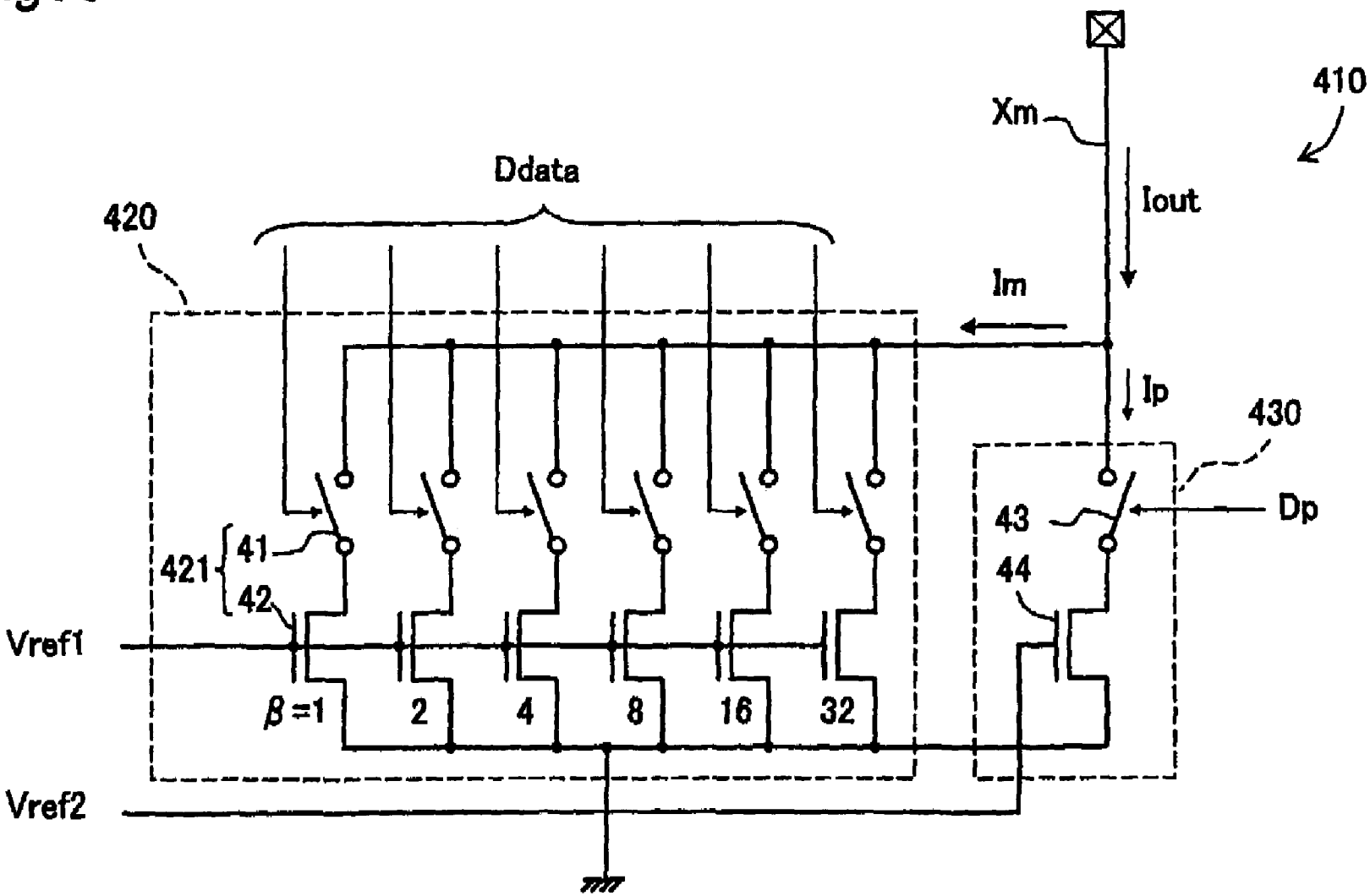
FIG. 6 is a circuit diagram which shows the internal structure of a single-line driver 410 in the first embodiment.

FIG. 6 is a circuit diagram which shows the internal structure of one of the single-line drivers 410. This single-line driver 410 is equipped with a data signal generating circuit 420 (also called a "control current generator" or "current generating circuit"), and an additional current generation circuit 430 (also called an "additional current generator"). The data signal generating circuit 420 and additional current generation circuit 430 are connected in parallel between the data line Xm and the ground.

The data signal generating circuit 420 has a structure in which N series connections 421 of a switching transistor 41 and a driving transistor 42 are connected in parallel, where N is an integer equal to or greater than 2. In the example shown in FIG. 6, N is 6. A reference voltage Vref1 is applied in common to the gates of the six driving transistors 42. The ratio of the gain coefficients □ of the six driving transistors 42 is set at 1:2:4:8:16:32. As is well known, the gain coefficient □ is defined as □=(□$C_0$W/L). Here, □ is the carrier mobility, $C_0$ is the gate capacitance, W is the channel width, and L is the channel length. Each of the six driving transistors 42 functions as a constant current source. Since the current driving capacity of a transistor is proportional to the gain coefficient □, the ratio of the current driving capacities of the six driving transistors 42 is 1:2:4:8:16:32.

The on/off switching of the six switching transistors 41 is controlled by a 6-bit data driving signal Ddata (also called an "input signal") that is supplied from the controller 100 (FIG. 2). The least significant bit of the data driving signal Ddata is supplied to the series connection 421 with the smallest gain coefficient □ (i.e., to the series connection in which the relative value of □ is 1), and the most significant bit is supplied to the series connection 421 with the largest gain coefficient □ (i.e., to the series connection in which the relative value of □ is 32). As a result, the data signal generating circuit 420 functions as a current source that generates a current value Im that is proportional to the value of the data driving signal Ddata. The value of the data driving signal Ddata is set at a value that indicates the emission level of the light to be emitted by the organic EL element 220. Accordingly, a data signal with a current value Im that corresponds to the emission level of the light to be emitted by the organic EL element 220 is output from the data signal generating circuit 420.

The additional current generation circuit 430 is constructed by the series connection of a switching transistor 43 and a driving transistor 44. A reference voltage Vref2 is applied to the gate electrode of the driving transistor 44. The on/off switching of the switching transistor 43 is controlled by an additional current control signal Dp supplied from the controller 100. When the switching transistor 43 is in an "on" state, a predetermined additional current Ip corresponding to the reference voltage Vref2 is output on the data line Xm from the additional current generation circuit 430.

Figures 7A, 7B, 7C:
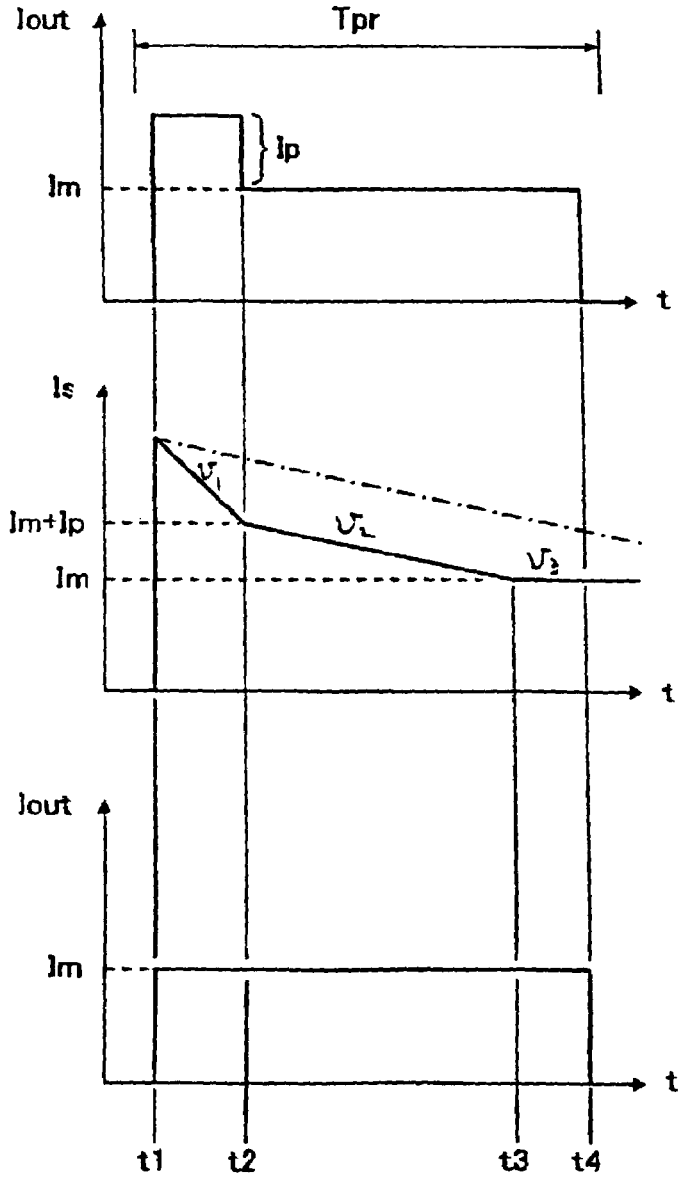
FIGS. 7(*a*)-7(*c*) are explanatory diagrams which show the variation in the current value during the programming period Tpr in a case where an additional current generation circuit 430 is utilized.

FIGS. 7(*a*)-(*c*) are explanatory diagrams which show the variation of the current value in the programming period Tpr (FIG. 5) in a case where the additional current generation circuit 430 is used. At the point in time t1, the data signal generation circuit 430 begins to output the programming current Im, and the additional current generation circuit 430 also begins to output the additional current Ip; in this case, the current value Iout that is output from the single-line driver 410 is the sum of the programming current Im and the additional current Ip, (Im+Ip). In the period t2 to t4 after the additional current Ip is stopped at the point in time t2, only the programming current Im constitutes the output current of the single-line driver 410. For example, the period t1 to t2 during which the additional current Ip flows is set at a period that is equal to approximately the initial ¼ of the period t1 to t4 during which the programming current Im flows. The reason that the period t1 to t2 during which the additional current Ip flows is set equal to the initial stage of the period during which the programming current Im flows is to suppress the effects of the additional current Ip on the light emission level. The value of the additional current Ip is set, for example, at about a mean value of the maximum value and minimum value of the programming current Im.

To be more accurate, the output current Iout shown in FIG. 7(*a*) indicates the current driving capability of the single-line driver 410, and the actual current value Is on the data line Xm varies as indicated by the solid line in FIG. 7(*b*). Specifically, at the point in time t1, a transiently large current flows; however, this current gradually decreases, and approaches the current value (Im+Ip). When the additional current generation circuit 430 is switched "off" at the point in time t2, the actual current Is decreases even further. However, after the point in time t2, since the current value itself is small, the rate at which the data line capacitance Cd (FIG. 3) is charged or discharged drops; as a result, the variation rate of the current is smaller than in the period from t1 to t2. Furthermore, at the point in time t3, the actual current value Is decreases to the programming current value Im, and this programming current value Im is maintained during the period from t3 to t4. Accordingly, the pixel circuit 210 is programmed by the correct programming current value Im within the programming period Tpr.

The utilization of such an additional current Ip can be also viewed as "the operation that varies the programming current value Im from a first current value during the programming of the previous line to a second current value during the programming of the present line, through a plurality of periods (i.e., the period from t1 to t2 and the period from t2 to t3 in FIG. 7(*a*)) with different rates of variation in the current value over time". Furthermore, this variation from a first current value to a second current value is performed via a third current value (Im+Ip) that is the sum of the programming current Im during the present programming and the additional current Ip.

The one-dot chain line shown in FIG. 7(*b*) indicates the variation in the actual current value in a case in which an additional current Ip is not used, so that the current driving capability of the single-line driver 410 is fixed (FIG. 7(*c*)). In this case, the current value in the period from t1 to t2 is small compared to a case in which an additional current Ip is used; consequently, the variation rate of the current is also smaller. Accordingly, there may be cases in which the actual current Is does not reach the programming current value Im even at the point in time t4 at which programming is to be completed. In such cases, there is a possibility that the pixel circuit 210 will not be programmed to the correct emission level. Or, the problem of a need to extend the programming period Tpr in order to achieve correct programming may arise. On the other hand, if an additional current Ip is used, correct programming can be accomplished within the programming period Tpr.

Figures 8A, 8B, 8C:
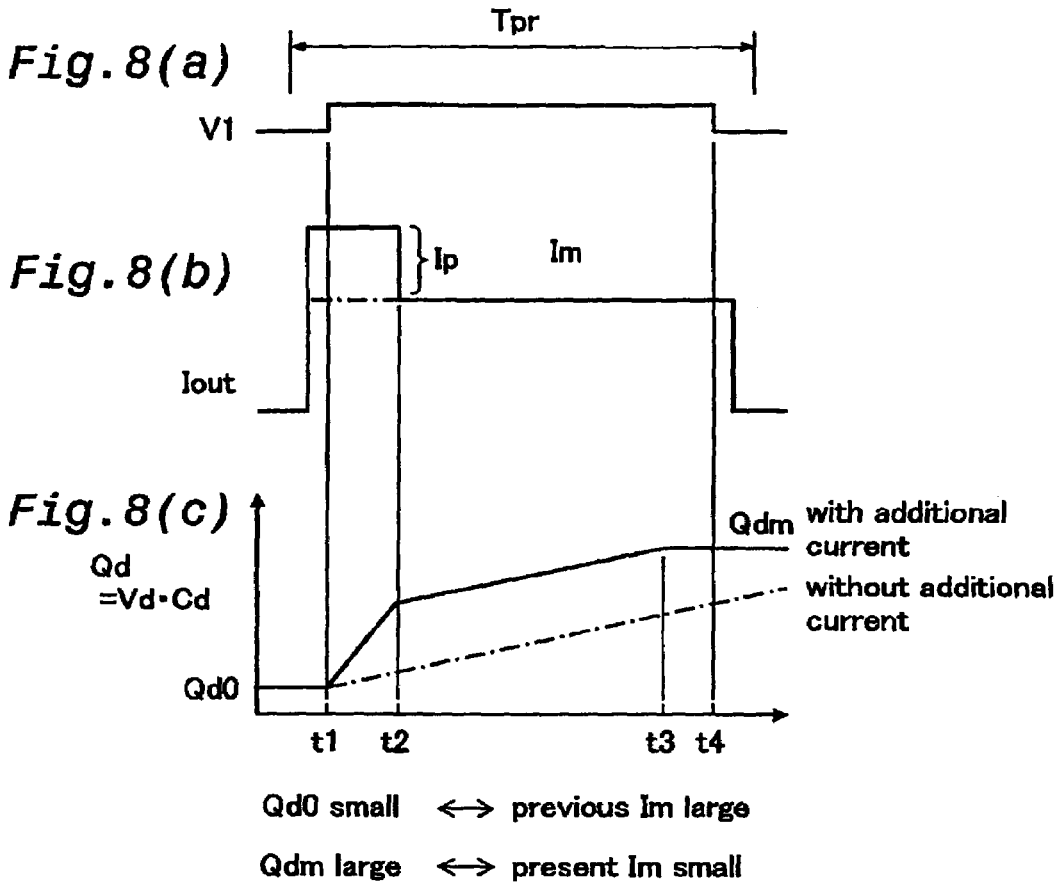
FIGS. 8(*a*)-8(*c*) are explanatory diagrams which show the variation in the charge quantity Qd of the data line Xm during the programming period Tpr.

FIGS. 8(*a*)-8(*c*) are explanatory diagrams which show the variation of the charge quantity Qd of the data line Xm during the programming period Tpr. FIGS. 8(*a*)-8(*c*) show the operation of FIGS. 7(*a*)-7(*c*) from the standpoint of electric charge. To be more accurate, the points in time t1 and t4 shown in FIG. 7(*c*) correspond to the points in time at which the level of the first gate signal V1 changes as shown in FIG. 8(*a*).

Figure 9A:
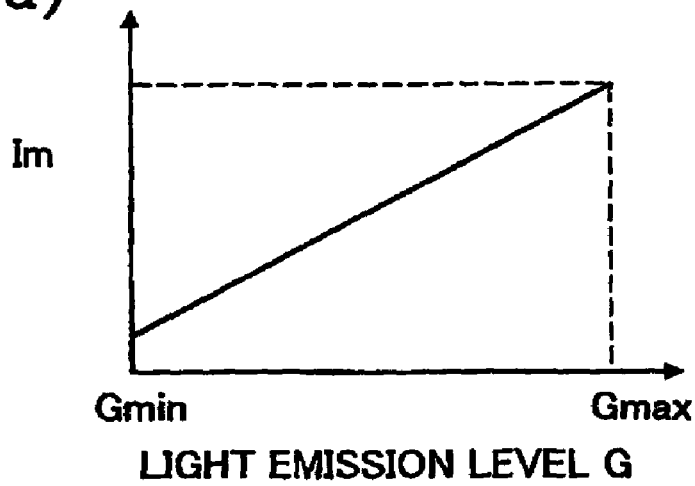
FIGS. 9(*a*) and 9(*b*) are graphs which show the relationship of a emission level G of light emitted by the organic EL element, a programming current Im and a charge quantity Qd of the data line.
Figure 9B:
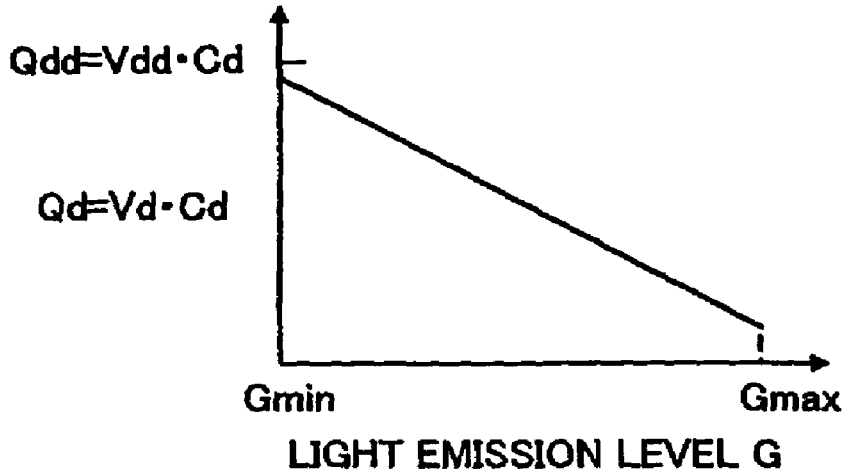

Generally, before the programming of the n-th row of pixel circuits is initiated, the charge Qc0 of the data line Xm depends on the programming current value Im of the data line Xm in the programming of the (n−1)th row of pixel circuits. FIGS. 9(*a*) and 9(*b*) show the relationship of the light emission level G of organic EL element, the current value Im of the data line Xm (i.e., the programming current value) and the charge quantity Qd of the data line. In the circuit structure of the first embodiment, the current Im tends to increase with an increase in the light emission level G (i.e., with an increase in the brightness), and the charge quantity Qd of the data line (i.e., the voltage Vd) tends to decrease with an increase in the emission level G. At the lowest emission level Gmin, the charge quantity Qd corresponds to a voltage that is close to the power supply voltage Vdd, and at the highest emission level Gmax, the charge quantity Qd corresponds to a voltage that is close to the ground voltage. Furthermore, in the example shown in FIG. 8(*c*), a case is envisioned in which the programming current value Im in the programming of the immediately preceding row (i.e., the (n−1)th row) is relatively large, so that the charge quantity Qd0 prior to the initiation of the present programming is relatively small.

When programming is initiated at the point in time t1 in FIGS. 8(*a*)-8(*c*), the data line Xm is charged or discharged by the output current Iout (=Im +Ip) of the single-line driver 410, so that the charge quantity Qd increases at a relatively high rate. When the additional current Ip is eliminated at the point in time t2, the charging/discharging rate drops, and the variation in the charge quantity Qd also becomes more gradual. However, at the point in time t3 in the programming period Tpr, the charge quantity reaches Qdm that corresponds to the desired programming current value Im.

As may be seen from the above description, the additional current generation circuit 430 functions as a charging/discharging accelerating section that is used to accelerate the charging or discharging of the data line Xm. In the present specification, the term "acceleration of charging or discharging" refers to an operation that accelerates charging or discharging so that charging or discharging of the data line is completed in a shorter time than charging or discharging of the data line by the original desired current value alone (i.e., the programming current value Im in the case of the present embodiment). The additional current generation circuit 430 may also be viewed as a circuit that functions as an accelerating means for accelerating the variation in the current according to the variation in the data signal, or as a resetting means for resetting the charge quantity of the data line Xm to a specified value.

As is shown by the one-dot chain line in FIG. 8(*c*), the charging/discharging rate is maintained at a low rate in cases where there is no additional current Ip, so that in this example, the charge quantity does not reach the charge quantity Qdm corresponding to the desired programming current value Im even at the end t4 of the programming period Tpr. Accordingly, there is a high possibility that programming to the correct light emission level by supplying the correct programming current Im to the pixel circuit 210 cannot be achieved.

Thus, in the present embodiment, correct programming of the pixel circuit 210 can be accomplished by accelerating the charging or discharging of the data line using the additional current Ip. The programming time can be shortened, instead, so that the speed of the driving control of the organic EL element 220 can be increased.

The acceleration of the charging or discharging of the data line using the additional current Ip is typically performed for all of the data lines Xm contained in the pixel circuit matrix. However, it is also possible to devise the system so that the acceleration of the charging or discharging of these data lines using the additional current Ip is selectively performed for only some of the data lines among the plurality of data lines contained in the pixel circuit matrix. For example, in a case where the charge quantity Qd0 (FIG. 8(*c*)) of the m-th data line Xm at the time that programming is initiated is sufficiently close to the charge quantity Qdm corresponding to the desired programming current Im, the additional current Ip need not be used. In concrete terms, for the respective data lines, the controller 100 may compare the programming current value in the (n−1)th row with the programming current value in the n-th row, and if the difference is less than a specified threshold value, the controller 100 may judge that the additional current Ip will not be utilized during the programming of the n-th row. Furthermore, The value of the additional current Ip may be varied in accordance with the difference in these programming current values. In other words, it is possible to devise the system so that it comprises a means for determining the current value of the additional current Ip in accordance with the difference between the previous value and present value of the programming current value Im, and a means for supplying the determined additional current value Ip to the respective data lines Xm. In this structure, the additional current value Ip can be used more effectively, so that an increased driving speed can be promoted.

Alternatively, it is also possible to judge that the additional current Ip will be utilized only in cases where the present programming current value Im is smaller than a specified threshold value, and that the additional current Ip will not be utilized in cases where the programming current value Im is larger than the threshold value. The reason for this is as follows: namely, in cases where the programming current value is large, the charging or discharging of the data lines Xm can be performed with a sufficient speed, so that the desired programming current value Im can be obtained at a sufficiently high speed without using the additional current Ip.

Instead of this, it is also possible to utilize the additional current Ip only in cases where the present programming current value (second current value) is smaller than the previous programming current value (first current value) and the sum of the present programming current value Im and additional current value Ip (this sum being the third current value) is smaller than the previous programming current value. These three current values can also be set in various other relationships. For example, the third current value may also be a current value that is intermediate between the first current value and second current value. Furthermore, it would also be possible to set the absolute value of the current variation rate over time from the first current value to the third current value at a value that is larger than the absolute value of the current variation rate over time from the third current value to the second current value. Moreover, it would also be possible to set the absolute value of the difference between the first current value and the third current value at a value that is greater than the absolute value of the difference between the third current value and the second current value.

It is desirable that the above mentioned judgment as to whether or not to utilize the additional current Ip be performed for each data line. However, if the additional current Ip is always utilized regardless of the value of the programming current during the programming of the immediately preceding row, the advantage of simplified control of the display device as a whole is obtained.

Thus, in the present first embodiment, accurate programming can be accomplished in a short time by applying an additional current Ip to the programming current Im in the initial stage of the programming period. Alternatively, the programming period can be shortened, so that the speed of the driving control of the organic EL elements 220 is increased. In particular, an increase in the speed of the driving control is required in cases where the size or resolution of the display panel is increased; accordingly, the above mentioned effects are more valuable in large display panels and high-resolution display panels.

B. Second Embodiment (Current Addition 2)

Figure 10:
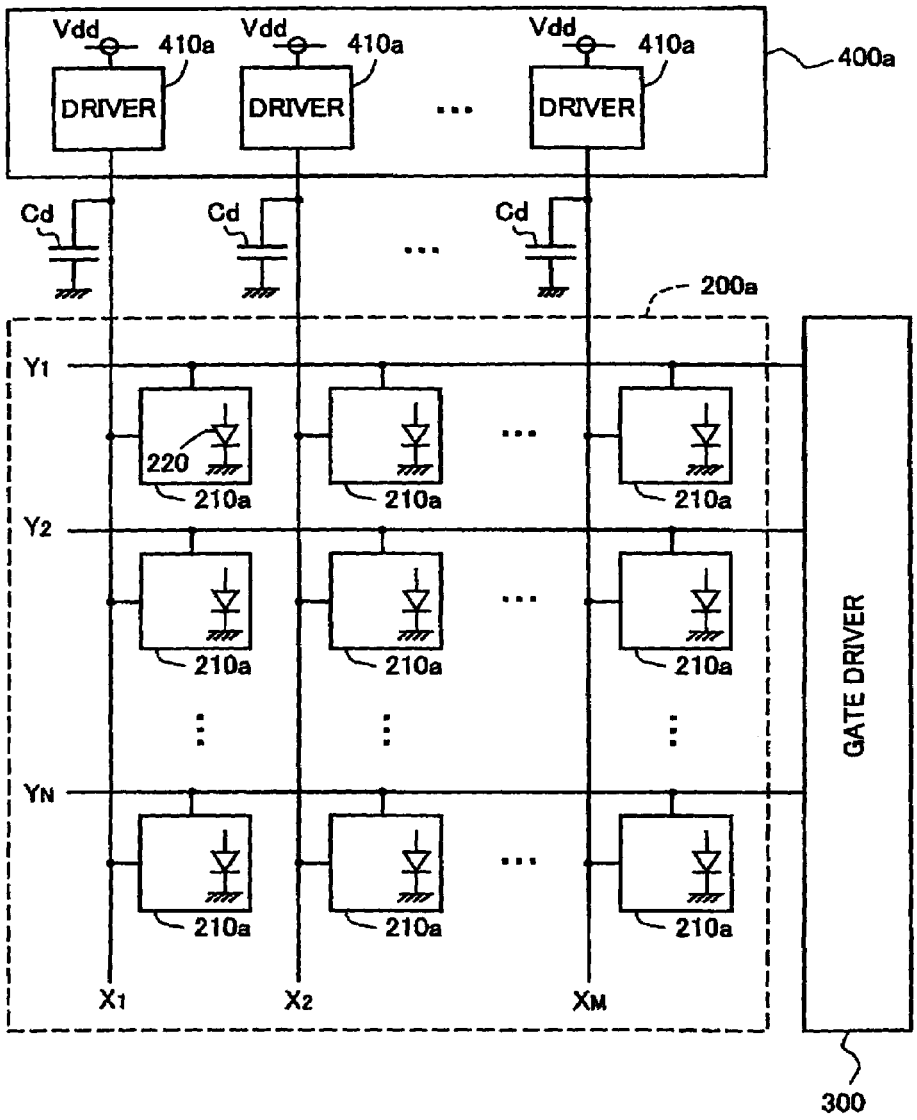
FIG. 10 is a block diagram which shows the structure of a display device as a second embodiment of the present invention.

FIG. 10 is a block diagram which shows the schematic structure of a display device as a second embodiment of the present invention. This display device differs from the first embodiment in that a data line driver 400*a* is installed on the side of the power supply voltage Vdd. Furthermore, as will be described below, the internal structure of the single-line drivers 410*a* and the internal structure of the pixel circuits 210 also differ from those of the first embodiment.

Figure 11:
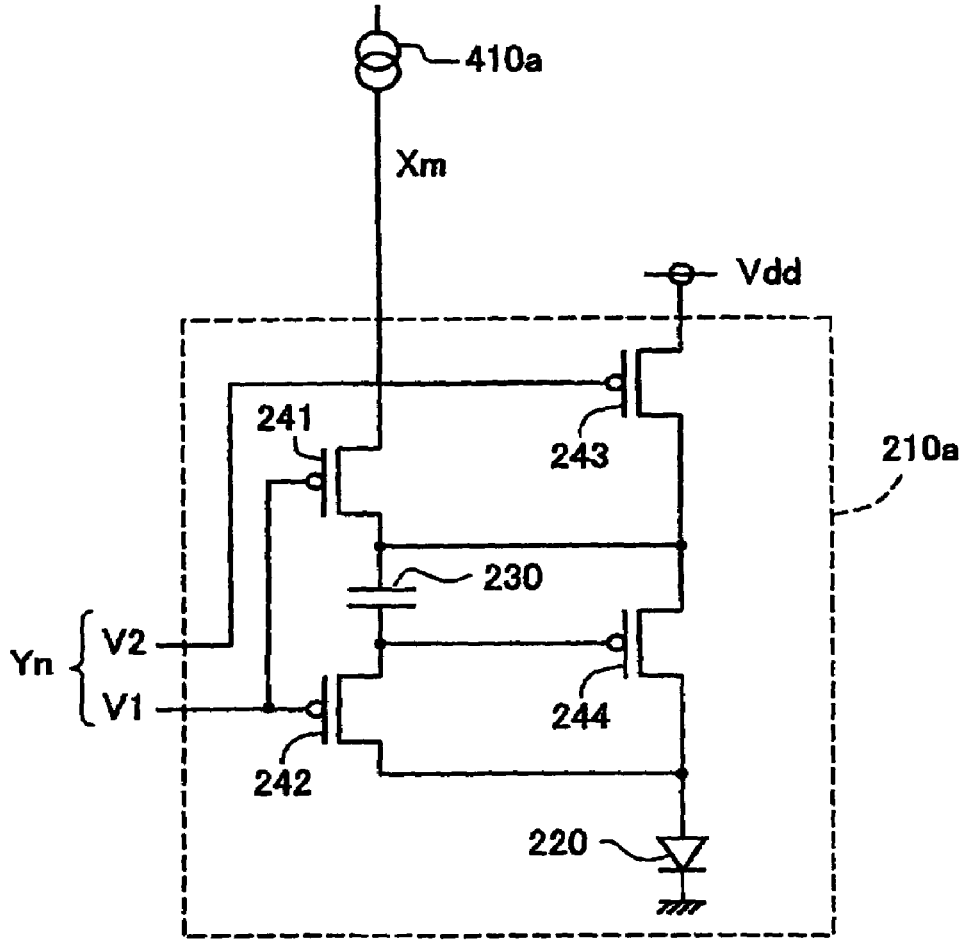
FIG. 11 is a circuit diagram which shows the internal structure of a pixel circuit 210*a* in the second embodiment.

FIG. 11 is a circuit diagram which shows the internal structure of one pixel circuit 210*a*. This pixel circuit 210*a* is a so-called Sarnoff type current-programmable circuit. This pixel circuit 210*a* has an organic EL element 220, four transistors 241 through 244, and a storage capacitor 230. Furthermore, the four transistors are p-channel type FETs.

The first transistor 241, storage capacitor 230 and second transistor 242 are connected in series in this order to the data line Xm. The drain of the second transistor 242 is connected to the organic EL element. The first sub-gate line V1 is connected in common to the gates of the first and second transistors 241 and 242.

A series connection of the third transistor 243, fourth transistor 244 and organic EL element 220 is interposed between the power supply voltage Vdd and the ground. The drain of the third transistor 243 and the source of the fourth transistor 244 are connected to the drain of the first transistor. The second gate line V2 is connected to the gate of the third transistor 243. The gate of the fourth transistor 244 is connected to the source of the second transistor 242. The storage capacitor 230 is connected between the source and gate of the fourth transistor 244.

The first and second transistors 241 and 242 are switching transistors that are used in accumulating a desired charge in the storage capacitor 230. The third transistor 243 is a switching transistor that is maintained in an "on" state during the light emission period of the organic EL element 220. The fourth transistor 244 is a driving transistor that is used to control the current value that flows through the organic EL element 220. The current value of the fourth transistor 244 is controlled by the charge quantity that is held in the storage capacitor 230.

Figures 12A, 12B, 12C, 12D:
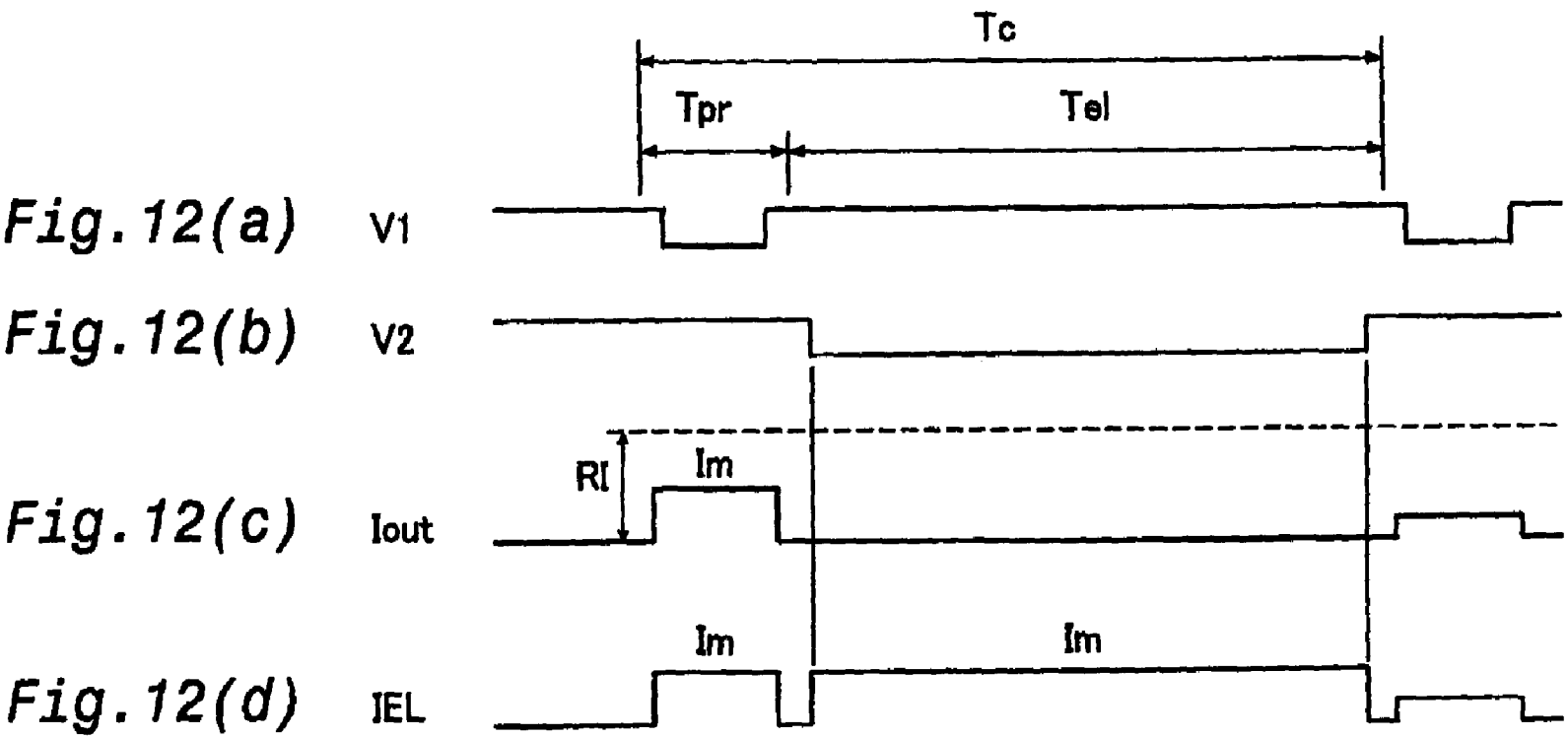
FIGS. 12(*a*)-12(*d*) are timing charts which shows the ordinary operation of a pixel circuit 210*a* in the second embodiment.

FIGS. 12(*a*)-12(*d*) are timing charts that shows the ordinary operation of the pixel circuit 210*a* of the second embodiment. In this operation, the logic of the gate signals V1 and V2 is inverted from the operation of the first embodiment shown in FIGS. 5(*a*)-5(*d*). Furthermore, in the second embodiment, as may be seen from the circuit structure shown in FIG. 11, a programming current Im flows through the organic EL element 220 via the first and fourth transistors 241 and 244 during the programming period Tpr. Accordingly, in the second embodiment, the organic EL element also emits light during the programming period Tpr. Thus, in the programming period Tpr, the organic EL element 220 may emit light, or may not emit light as in the first embodiment.

Figure 13:
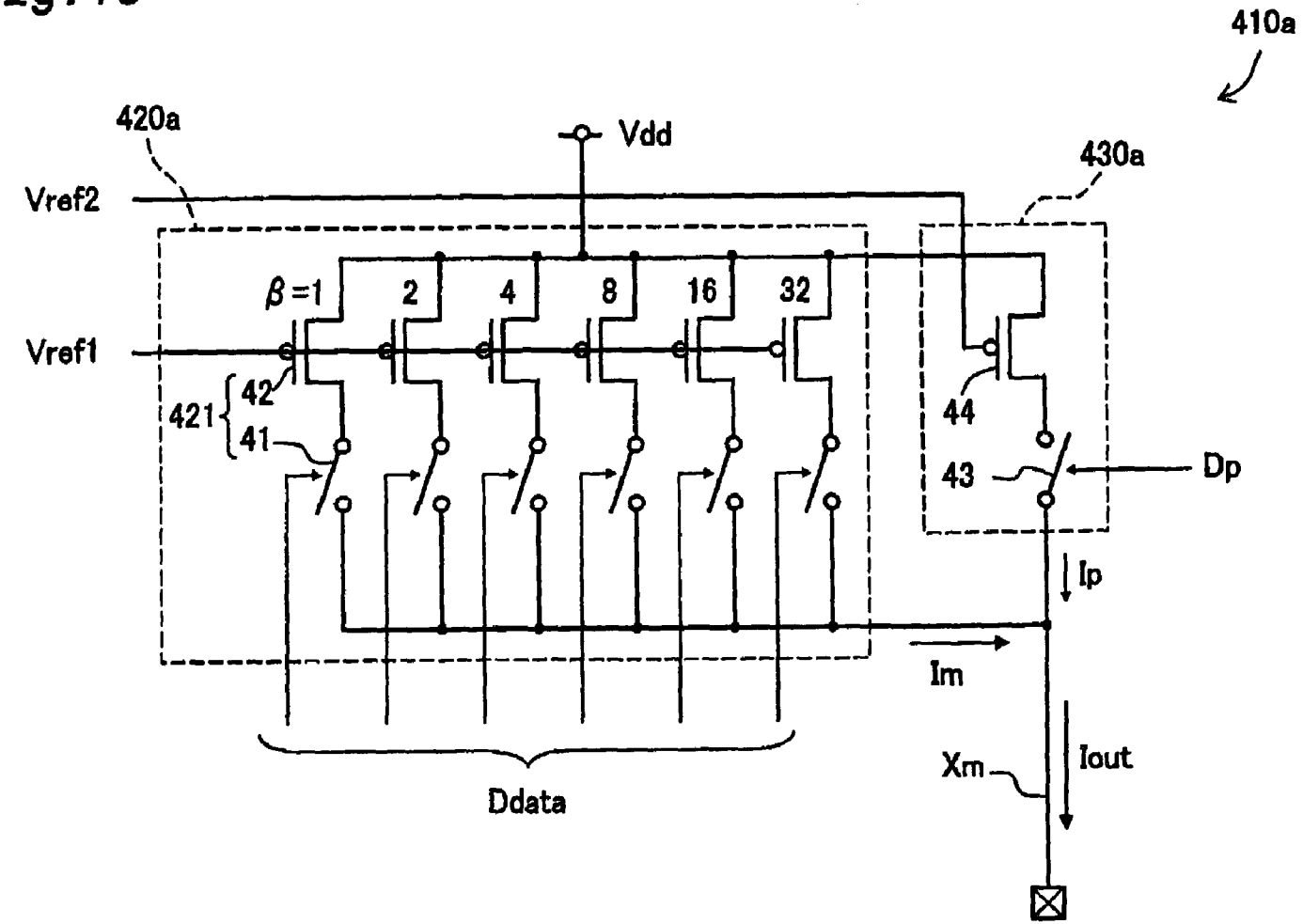
FIG. 13 is a circuit diagram which shows a single-line driver 41*a* in the second embodiment.

FIG. 13 is a circuit diagram that shows one of the single-line drivers 410*a* of the second embodiment. This single-line driver 410*a* is connected to the power supply voltage (Vdd) side of the data line Xm. As a result, this embodiment differs from the first embodiment shown in FIG. 6 in that the driving transistor 42 of the data signal generating circuit 420*a* and the driving transistor 44 of the additional current generation circuit 430*a* are both constructed from p-channel type FETs. The remaining structure is the same as that of the first embodiment.

Figure 14A:
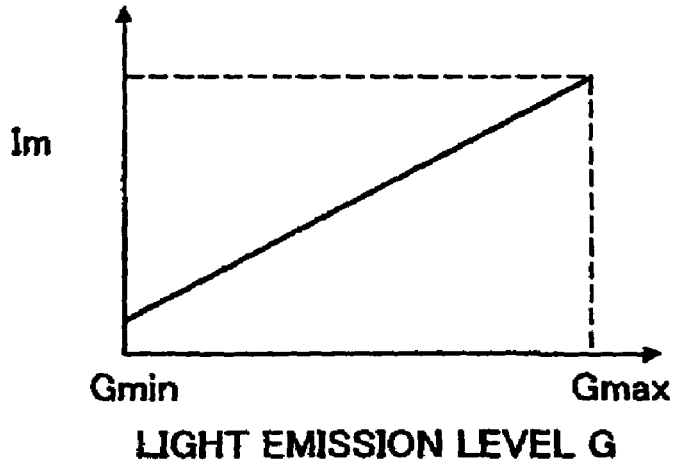
FIGS. 14(*a*) and 14(*b*) are graphs which show the relationship of the emission level G of the light emitted by the organic EL element, the programming current Im and the charge quantity Qd of the data line in the second embodiment.
Figure 14B:
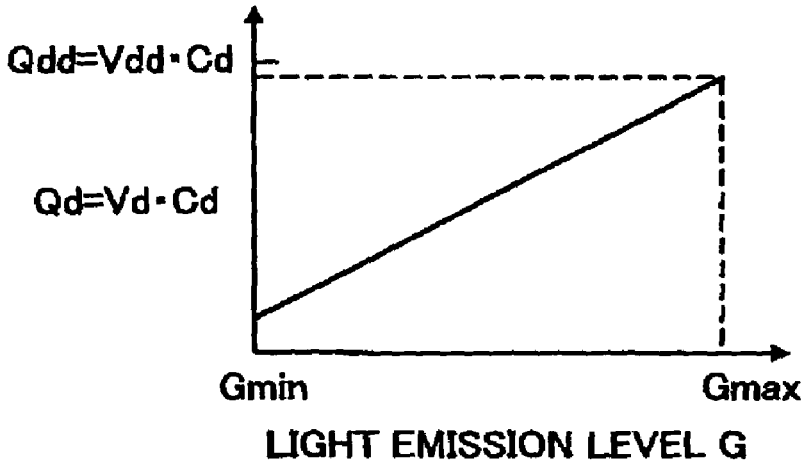

FIGS. 14(*a*) and 14(*b*) show the relationship of the emission level G of the light emitted by the organic EL element, the current value Im of the data line Xm and the charge quantity Qd of the data line in the second embodiment. In the second embodiment, conversely from the first embodiment, the single-line drivers 410*a* are installed on the power supply voltage (Vdd) side of the data lines Xm; accordingly, the relationship between the emission level G and charge quantity Qd (i.e., voltage Vd) of each data line Xm is the inverse of that in the first embodiment. Specifically, the charge quantity Qd (i.e., the voltage Vd) of each data line tends to rise as the emission level G increases (i.e., as the brightness increases). At the lowest emission level Gmin, the charge quantity Qd corresponds to a voltage that is close to the ground voltage, while at the highest emission level Gmax, the charge quantity Qd corresponds to a voltage that is closed to the power supply voltage Vdd.

Figures 15A, 15B, 15C:
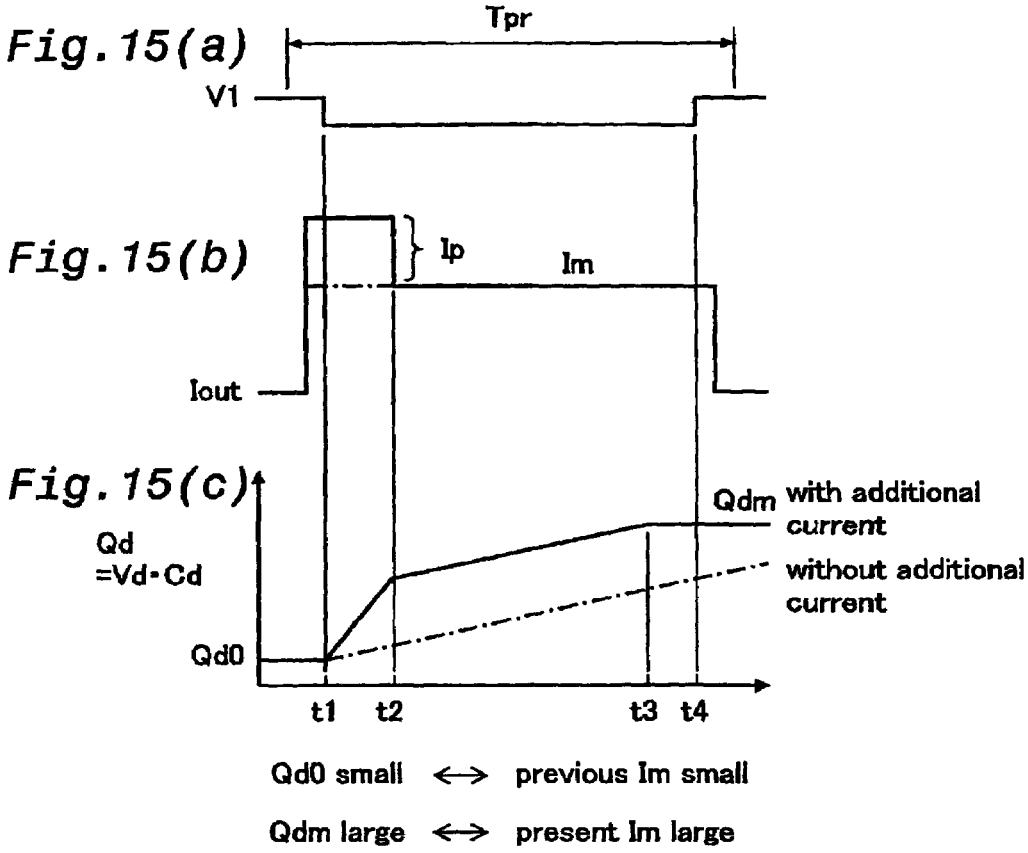
FIGS. 15(*a*)-15(*c*) are explanatory diagrams which show the variation of the charge quantity Qd of the data line Xm during the programming period Tpr in the second embodiment.

FIGS. 15(*a*)-15(*c*) are explanatory diagrams that show the variation of the charge quantity Qd of each data line Xm during the programming period Tpr in the second embodiment. This variation is essentially the same as the variation in the first embodiment shown in FIGS. 8(*a*)-8(*c*). However, the fact that the charge quantity Qd0 prior to the initiation of programming in FIG. 15(*c*) is relatively small means that (conversely from the first embodiment) the programming current value Im in the programming of the immediately preceding row (i.e., the (n−1)th row) is relatively small.

The display device of this second embodiment has effects similar to those of the first embodiment. Specifically, accurate programming of the pixel circuits 210*a* can be accomplished in a short time by adding an additional current Ip to the programming current Im in the initial stage of the programming period Tpr. The programming time can be shortened, instead, so that the speed of the driving control of the organic EL elements 220 can be increased.

C. Third Embodiment (Current Addition 3)

Figure 16:
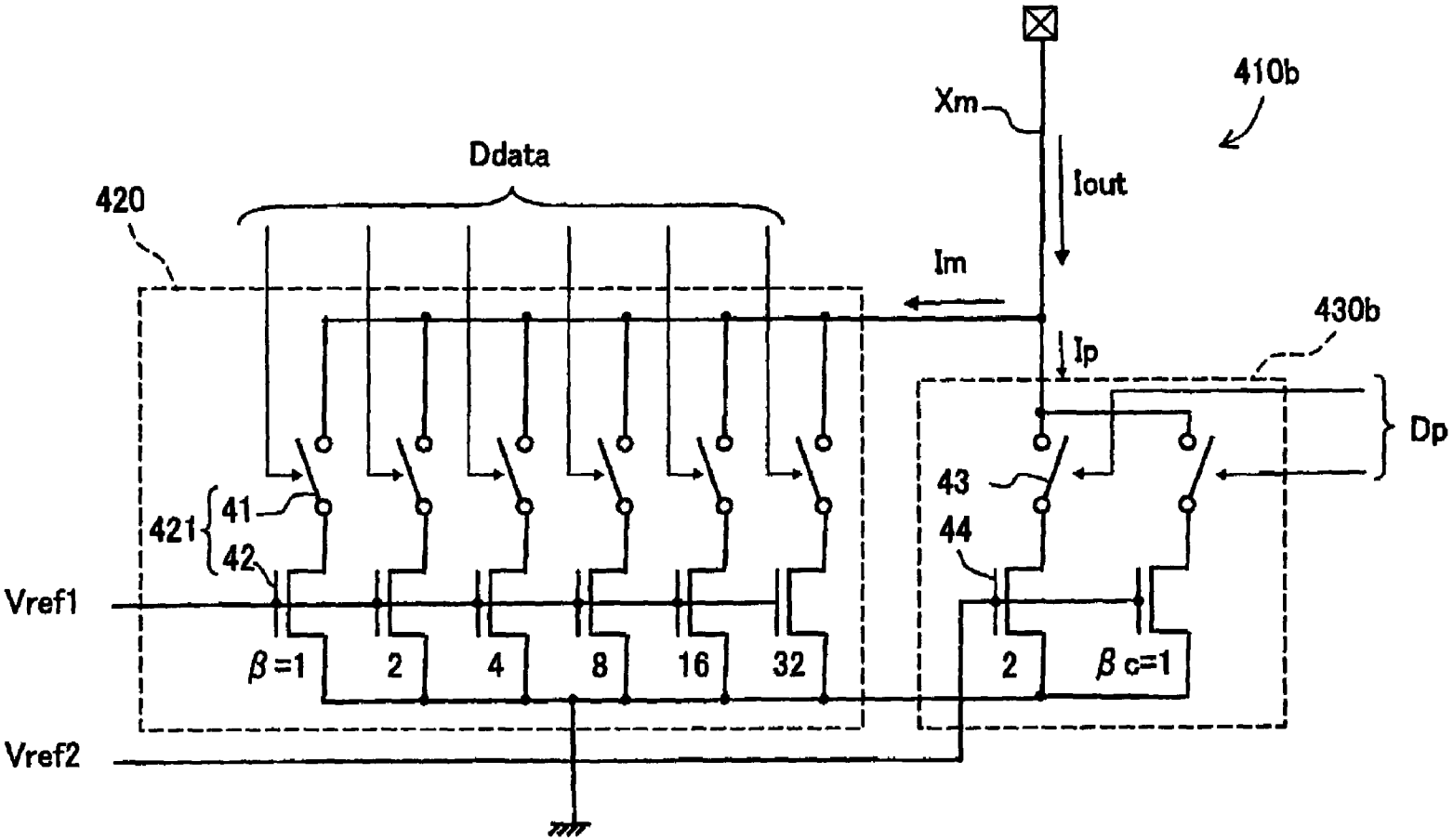
FIG. 16 is a circuit diagram which shows a single-line driver 410*b* in a third embodiment of the present invention.

FIG. 16 is a circuit diagram that shows one of the single-line driver circuits 410*b* in a third embodiment of the present invention. The data signal generating circuit 420 inside this single-line driver 410*b* is the same as that of the first embodiment shown in FIG. 6; however, the structure of the additional current generation circuit 430*b* differs from that of the first embodiment. Specifically, this additional current generation circuit 430*b* has two sets of series connections of a switching transistor 43 and driving transistor 42, and these series connections are connected in parallel with each other. For example, the ratio of the gain coefficients □c of the two driving transistors 44 is set at 1:2. The additional current control signal Dp is a two-bit signal in this embodiment. In cases where this additional current generation circuit 430*b* is used, the additional current value Ip can be arbitrarily set at any of four levels corresponding to the four values 0 through 3 that can be represented by the additional current control signal Dp.

Figures 17A, 17B, 17C:
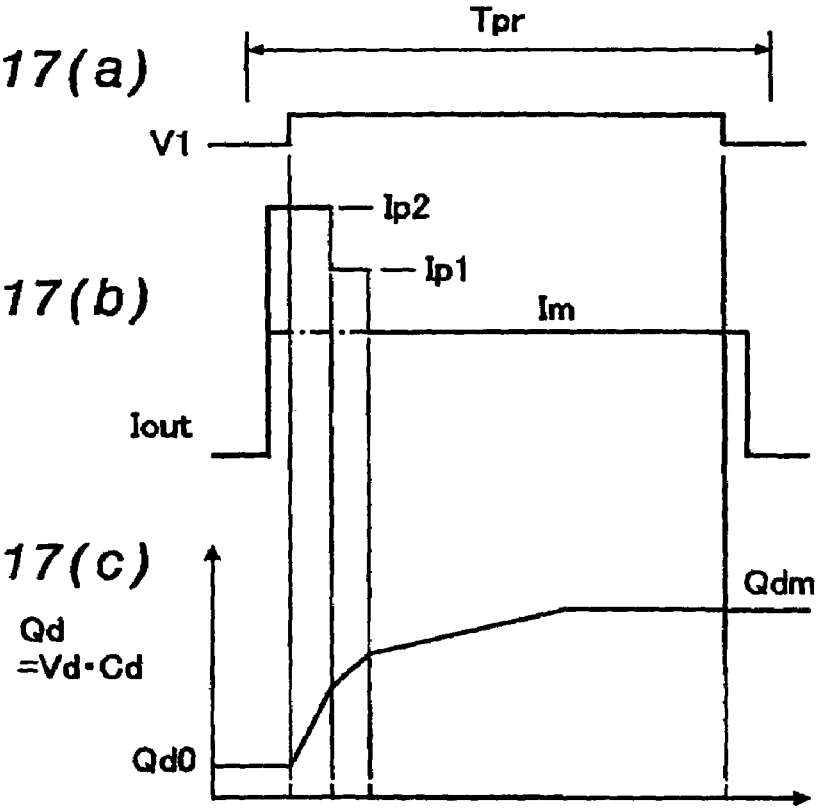
FIGS. 17(*a*)-17(*c*) are explanatory diagrams which show the operation of the programming period Tpr in a case where the additional current generation circuit 430*a* of a third embodiment is utilized.

FIGS. 17(*a*)-17(*c*) are explanatory diagrams that show the operation during the programming period Tpr in a case where the additional current generation circuit 430*b* of the third embodiment is utilized. Here, the additional current value Ip varies from a higher first level Ip2 to a lower second level Ip1. As a result, there is a possibility that the data lines can be charged or discharged more quickly than in the first embodiment or second embodiment. As may be seen from this example, in cases where an additional current is utilized, the system may be arranged so that the additional current value is varied in two or more stages, thus varying the output current Iout of the data lines Xm in three or more stages.

In a case where the additional current generation circuit 430*b* of FIG. 16 is used, as in the case of the first embodiment, the level of the additional current value Ip can be determined in accordance with the programming current value for the immediately preceding row and the programming current value for the present row. If this is done, then appropriate additional current values that are suited to the programming current values can be selectively utilized.

It should be noted here that the additional current generation circuit 430*b* utilizing multiple additional current values Ip can be applied to the second embodiment.

D. Modifications Utilizing Current Addition

Modification D1:

The additional current generation circuit need not be installed within the single-line driver 410; this circuit may be installed in some other position as long as the circuit is connected to the corresponding data line Xm. Furthermore, instead of installing one additional current generation circuit for each data line Xm, it is also possible to install one additional current generation circuit commonly for a plurality of data lines.

Modification D2:

It would also be possible to arrange the system so that no additional current generation circuit is installed, and so that a current value that is larger than the programming current value Im is generated by the data signal generation circuit 420 during the initial stage of the programming period, and the current value is then switched to the programming current value Im after a specified period of time has elapsed.

As may be seen from the respective embodiments and modifications described above, it is generally sufficient to cause a current that is larger than the programming current value Im to flow through the data lines in the initial stage of the programming period when an additional current is utilized. By doing this, it is possible to accelerate the charging or discharging of the data lines, so that accurate programming and high-speed driving are possible.

E. Fourth Embodiment (Pre-Charging)

Figure 18:
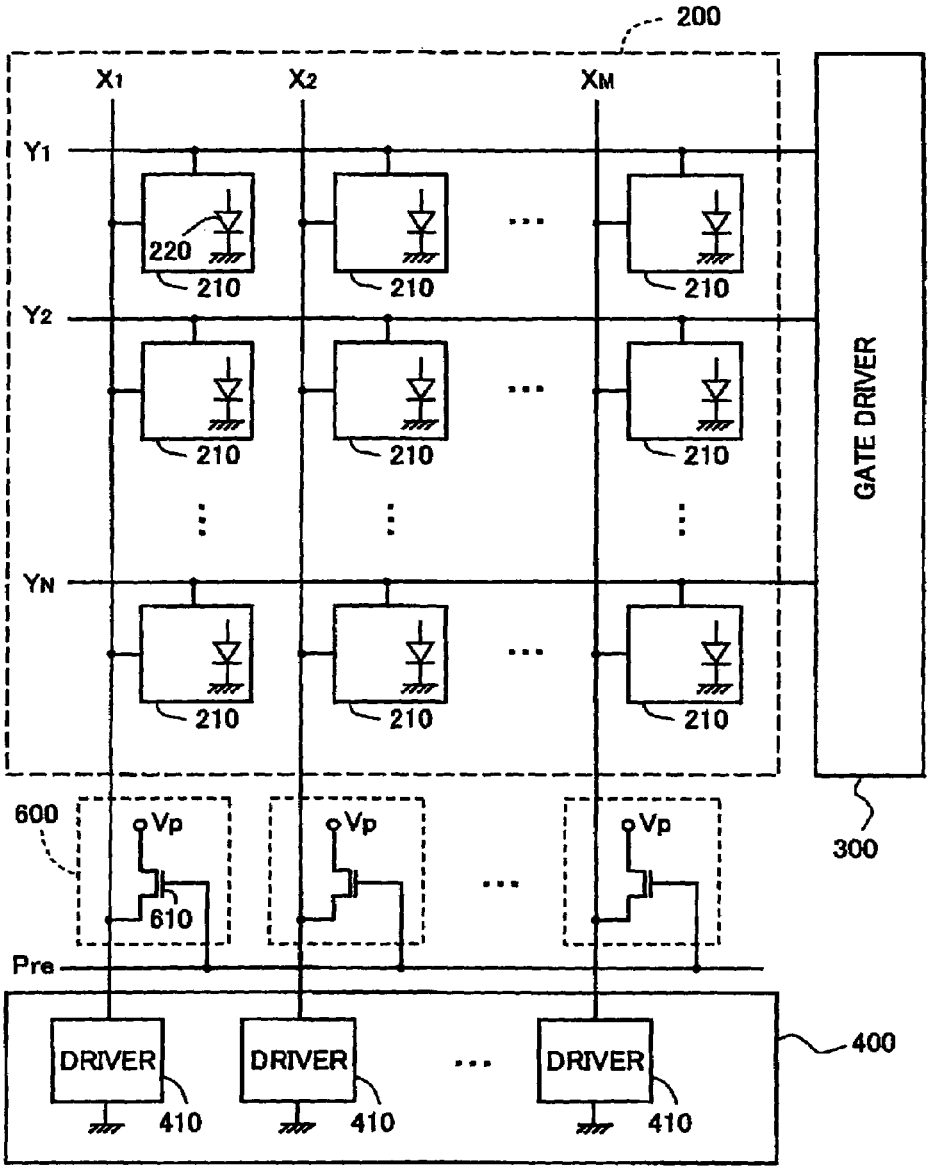
FIG. 18 is a block diagram which shows the structure of a display device as a fourth embodiment of the present invention.

FIG. 18 is a block diagram which illustrates the structure of a display device as a fourth embodiment of the present invention. In this display device, a pre-charging circuit 600 is installed for each of the data lines Xm (m=1 through M) of the display device of the first embodiment shown in FIG. 3. The remaining structure is the same as that shown in FIG. 3. However, the electrostatic capacitance Cd of the data lines is omitted for the sake of convenience of illustration. Furthermore, circuitry that does not have an additional current generation circuit 430 (FIG. 6) may be used as the single-line drivers 410.

Pre-charging circuits 600 are respectively connected to each data line Xm in a position between the display matrix section 200 and the data line driver 400. These pre-charging circuits 600 are each constructed from a series connection of a pre-charging power supply Vp which is a constant voltage source, and a switching transistor 610. In this example, the switching transistor 610 is an n-channel type FET, and the source of this transistor is connected to the corresponding data line Xn. A pre-charging control signal Pre is input in common to the gate of each switching transistor 610 form the controller 100 (FIG. 2). The voltage of the pre-charging power supply Vp is set, for example, at the driving power supply voltage Vdd (FIG. 4) of the pixel circuits 210. However, a power supply circuit that allows arbitrary adjustment of the pre-charging voltage Vp may also be employed.

The pre-charging circuits 600 are used to shorting the time required for programming by performing charging or discharging of the respective data lines Xm prior to the completion of programming. In other words, the pre-charging circuits 600 function as charging/discharging accelerating sections that are used to accelerate the charging or discharging of the data lines Xm. Furthermore, the pre-charging circuits 600 may also be viewed as circuits that function as accelerating means for accelerating the variation in the current that accompanies the variation in the data signals, or as resetting means for resetting the charge quantities of the data lines Xm to specified values.

FIGS. 19(*a*)-19(*d*) are explanatory diagrams which show the operation during the programming period Tpr in the fourth embodiment. In this example, the pre-charging control signal Pre is at the H level during the period from t11 to t12 prior to the execution of programming in the period from t13 to t15, so that pre-charging or pre-discharging is performed by the pre-charging circuits 600 during this period. As a result of this pre-charging, the charge quantities Qd of the data lines Xm reach a specific value corresponding to the pre-charging voltage Vp (FIG. 18). In other words, the data lines Xm reach a voltage that is more or less equal to the pre-charging voltage Vp. Afterward, when programming is performed in the period from t13 to t15, the charge quantities Qd of the data lines Xn reach a charge quantity Qdm corresponding to the desired programming current value Im at the point in time t14 within the programming period Tpr.

The one-dot chain line in FIG. 19(*d*) indicates the variation in the charge quantities in a case where no pre-charging or additional current is utilized. In this case, the charge quantities of the data lines do not reach a charge quantity Qdm corresponding to the desired programming current value Im even at the end of the programming period Tpr. Accordingly, there is a possibility that programming to the correct emission levels by supplying the correct programming current Im to the pixel circuits 210 cannot be accomplished.

Thus, in the present embodiment, the correct light emission levels can be set for the pixel circuits 210 by the pre-charging which accelerates the charging or discharging of the data lines.

In cases where the data line driver 400 is installed on the ground voltage side of the data lines Xm, the charge quantities Qd of the data lines increase with a decrease in the programming current value Im as is shown in FIGS. 9(*a*) and 9(*b*) above, so that the voltage Vd is also large. In this case, it is desirable that the pre-charging voltage Vp be set at a relatively high voltage level corresponding to the relatively small programming current value Im (i.e., the relatively low light emission level).

On the other hand, in cases where the data line driver 400 is installed on the power supply voltage side of the data lines Xm, the charge quantities Qd of the data lines decrease with a decrease in the programming current value Im as is shown in FIG. 14(*a*)-14(*c*) above, so that the voltage Vd is also small. In this case, it is desirable that the pre-charging voltage Vp be set at a relatively low voltage level corresponding to the relatively small programming current value Im (i.e., the relatively low light emission level).

In concrete terms, it is desirable that the pre-charging voltage Vp be set so that the data lines can be pre-charged to a voltage level corresponding to a low light emission range equal to or lower than the center value of the light emission level. In particular, it is desirable to set the pre-charging voltage Vp so that the data lines can be pre-charged to a voltage level corresponding to a light emission level in the vicinity of the lowest non-zero light emission level. Here, the term "a light emission level in the vicinity of the lowest non-zero light emission level" refers to, for example, a range of 1 to 10 in a case where the overall range is 0 to 255. If this is done, then programming can be performed at a sufficiently high speed even in cases where the programming current value Im is small.

As in the case of the respective embodiments and modifications using an additional current described above, the judgment as to whether or not to perform pre-charging can also be made in accordance with the programming current value for the immediately preceding row and the programming current value for the present row. For example, in a case where the charge quantity Qd0 (FIG. 19(*c*)) of the m-th data line Xm at the time that programming is initiated is sufficiently close to the desired programming current Im, pre-charging need not be performed for this data line Xm. Alternatively, it would also be possible to judge that pre-charging will be utilized only in cases where the present programming current value Im is smaller than a specified threshold value, and that pre-charging will not be utilized in cases where the present programming current value Im is greater than this threshold value. The reason for this is as follows: namely, in cases where the programming current value Im is large, the charging or discharging of the data lines Xm can be performed at a sufficiently high speed; accordingly, the desired programming current value Im can be reached even if pre-charging is not performed.

Furthermore, in cases where a judgment is made as to whether or not pre-charging should be performed for each data line, pre-charging can be performed selectively. However, if pre-charging is always performed for all of the data lines, the advantage of simplification of the control of the overall display device is obtained.

Incidentally, a color display device is ordinarily equipped with pixel circuits of the three color components R, G and B. In this case, it is desirable to construct the device so that the pre-charging voltage Vp can be independently set for each color. In concrete terms, it is desirable to provide three pre-charging power supply circuits so that respectively appropriate pre-charging voltages Vp can be set for the R data line, B data lines and G data lines. Furthermore, in cases where pixel circuits of three color components are connected to the same data line, it is desirable to use a variable power supply circuit that allows alteration of the output voltage as the pre-charging power supply circuit. If the system is devised so that pre-charging voltages Vp can be set separately for the respective colors, the pre-charging operation can be performed more efficiently.

F. Modifications Relating to Timing of Pre-Charging

FIGS. 20(*a*)-20(*c*) are explanatory diagrams which show a modification of the pre-charging period. In this example, the period Tpc during which the pre-charging signal Pre is "on" (also called the "pre-charging period Tpc") is extended to a time that overlaps with the initial stage of the period during which the first gate signal V1 is "on". In this case, the two switching transistors 211 and 212 used to charge or discharge the storage capacitor 230 (FIG. 4) are in an "on" state during the latter half of the pre-charging period Tpc; consequently, this storage capacitor 230 can be pre-charged at the same time as the data line Xm. Accordingly, in cases where the electrostatic capacitance of the storage capacitor cannot be ignored relative to the electrostatic capacitance Cd of the data line Xm, the time required for the subsequent return to programming can be shortened.

On the other hand, if the system is devised so that pre-charging is performed prior to the initiation of actual programming as shown in FIGS. 19(*a*)-19(*d*), the effect of pre-charging on the accumulated charge quantity of the storage capacitor can be suppressed to an even lower level.

It should be also noted, in FIGS. 20(*a*)-20(*c*), the programming current Im is maintained at 0 until the pre-charging period Tpc is completed. The reason for this is as follows: if the programming current Im is caused to flow during the pre-charging period Tpc, a portion of this current will also flow through the pre-charging circuits 600, so that wasteful power consumption results. However, in cases where the amount of power consumed by this operation is negligible, the system may be devised so that the programming current Im flows during the pre-charging period Tpc.

Figures 21A, 21B, 21C:
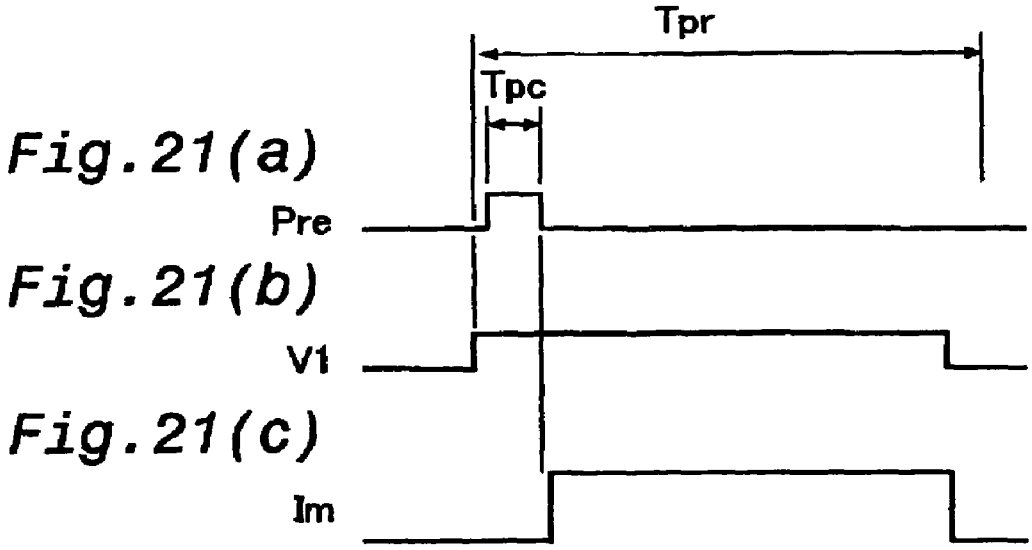
FIGS. 21(*a*)-21(*c*) are explanatory diagrams which illustrate a modification of the pre-charging period.

FIGS. 21(*a*)-21(*c*) are explanatory diagrams which illustrate another modification of the pre-charging period. In this example, the pre-charging period Tpc is initiated after the first gate signal V1 has been switched "on". In this case as well, the storage capacitor 230 can be pre-charged at the same time as the data line Xm. In this example as well, it is desirable that the programming current Im be maintained at 0 until the pre-charging period Tpc is completed.

As may be seen from the above description, the pre-charging period may be set prior to the period during which the programming of the pixel circuits is performed (example of FIGS. 19(*a*)-19(*c*)), or may be set as a period that includes a portion of the initial stage of the period during which the programming of the pixel circuits is performed (e.g., as in the cases illustrated in FIGS. 20(*a*)-20(*c*) and 21(*a*)-21(*c*)). Here, the term "period during which programming is performed" refers to a period in which the gate signal V1 is in an "on" state, and the switching transistors that connect the data line Xm and storage capacitor 230 (e.g., 211 and 212 in FIG. 4) are in an "on" state. In other words, it is desirable that pre-charging be performed during a specified pre-charging period prior to the completion of the programming period. If this is done, the pre-charging is performed prior to the completion of the accumulation of a charge (storage of a voltage) in the storage capacitor 230; accordingly deviation of the accumulated charge quantity of the storage capacitor 230 from the desired value due to pre-charging can be prevented.

G. Modifications Relating to Layout of Pre-Charging Circuit

Figure 24:
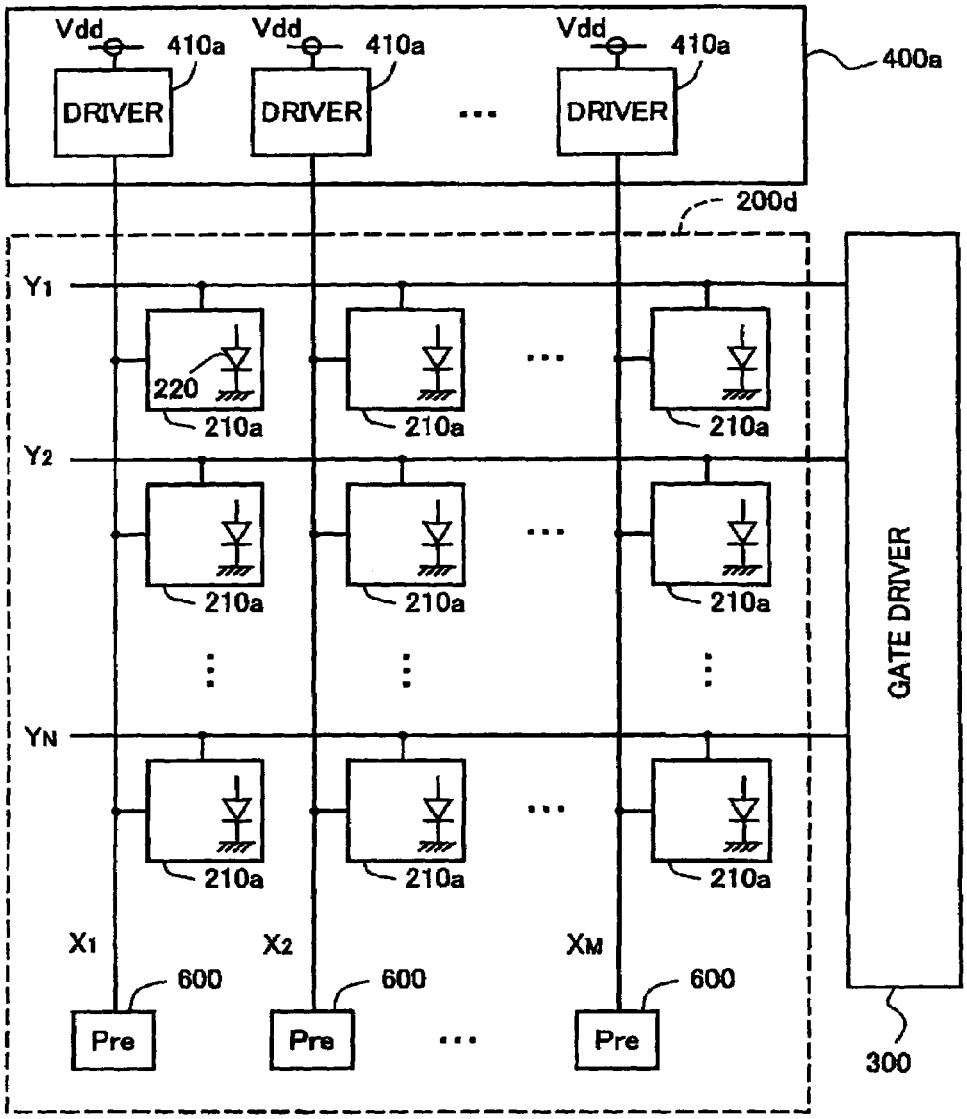
FIG. 24 is a block diagram which illustrates a modification of the layout of the pre-charging circuit.
Figure 25:
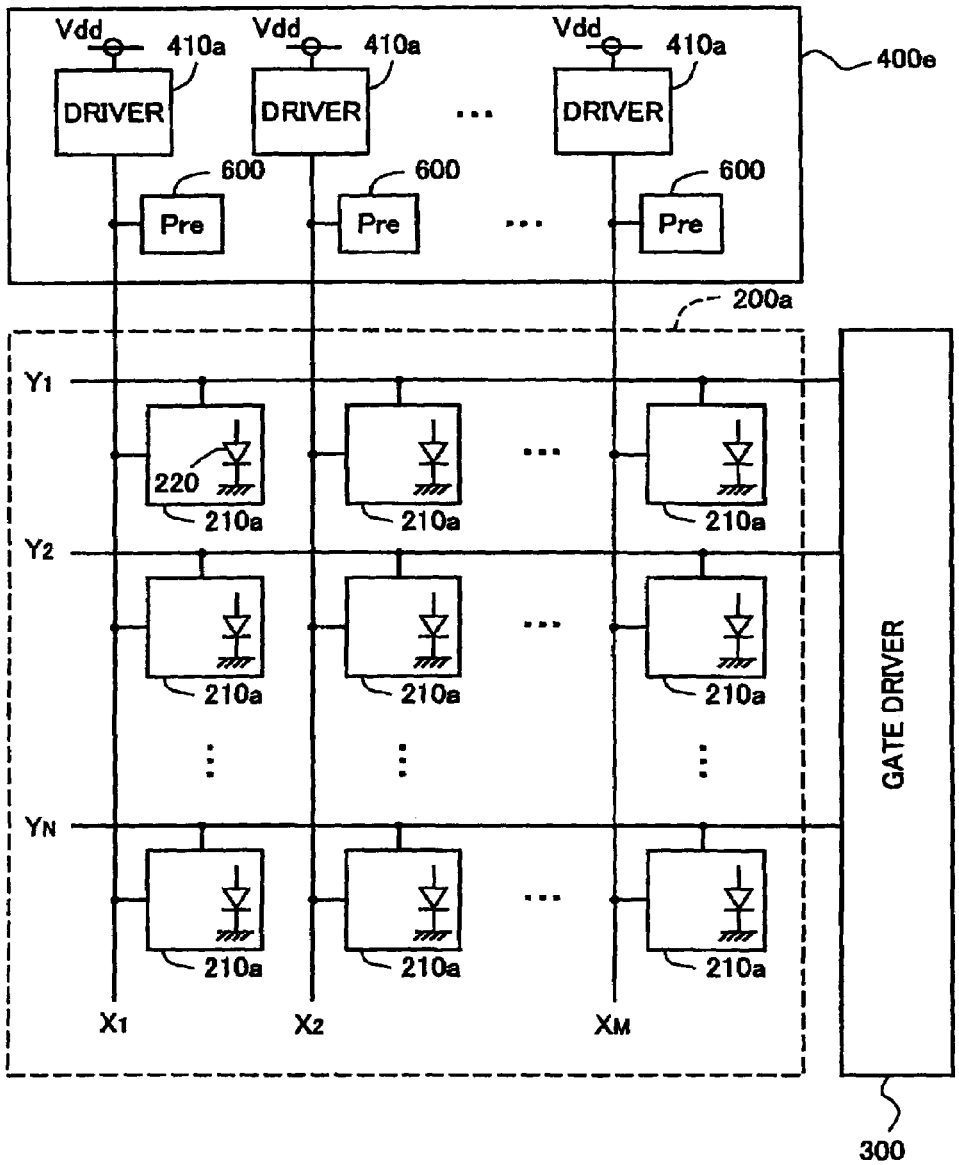
FIG. 25 is a block diagram which illustrates a modification of the layout of the pre-charging circuit.

FIGS. 22 through 25 shows various modifications of the layout of the pre-charging circuits 600. In the example shown in FIG. 22, a plurality of pre-charging circuits 600 are installed within the display matrix section 200*b*. This structure is obtained by adding the pre-charging circuits 600 to the display matrix section 200 of the first embodiment shown in FIG. 3. In the example shown in FIG. 23, a plurality of pre-charging circuits 600 are installed within the data line driver 400*c*. The example shown in FIG. 24 is also an example in which a plurality of pre-charging circuits 600 are installed within the display matrix section 200*d*. The structure shown in FIG. 24 is obtained by adding the pre-charging circuits 600 to the display matrix section 200*a* of the second embodiment shown in FIG. 10. In the example shown in FIG. 25, a plurality of pre-charging circuits 600 are installed within the data line driver 400*e*. The operations of the circuits shown in FIGS. 22 through 25 are more or less the same as the operation of the above mentioned fourth embodiment.

Figure 22:
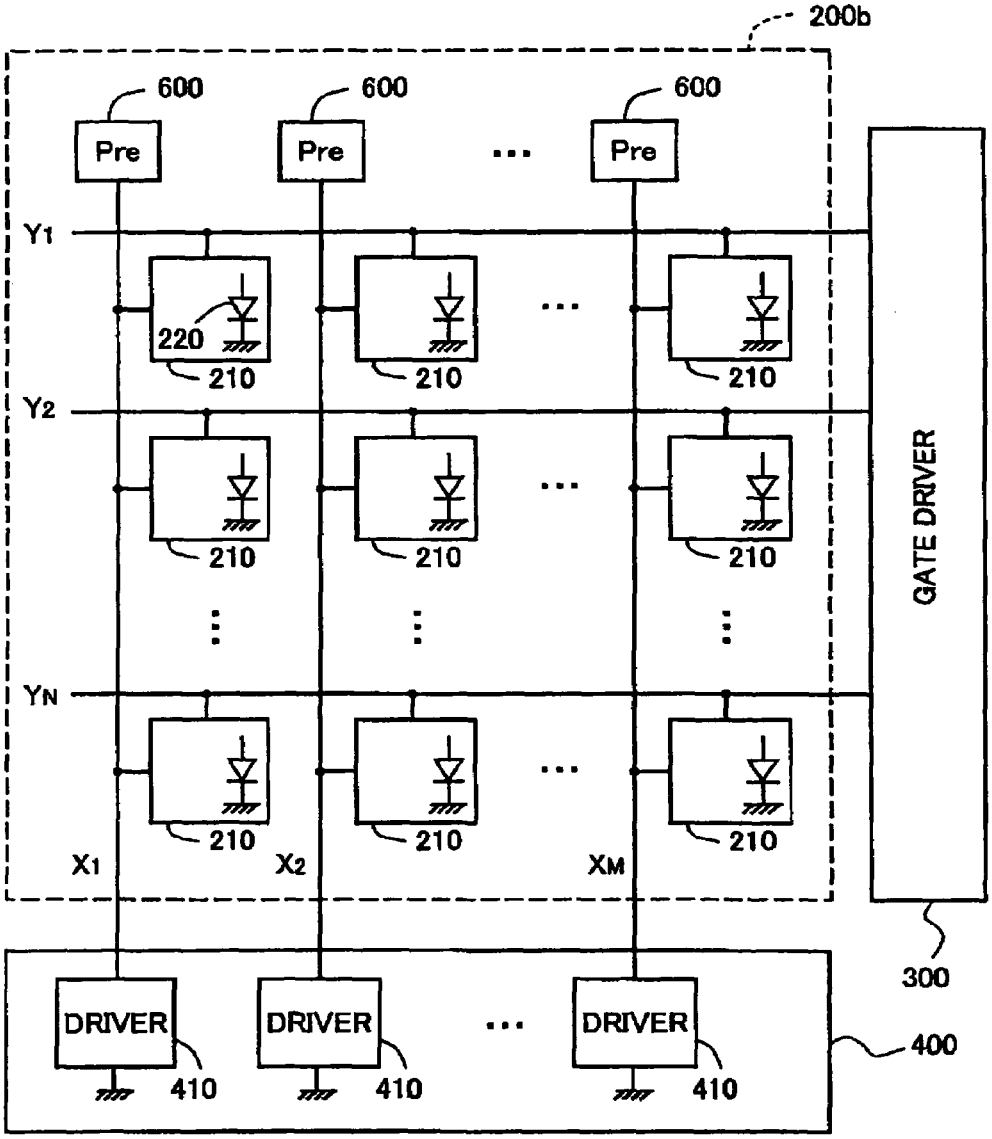
FIG. 22 is a block diagram which illustrates a modification of the layout of the pre-charging circuit.
Figure 23:
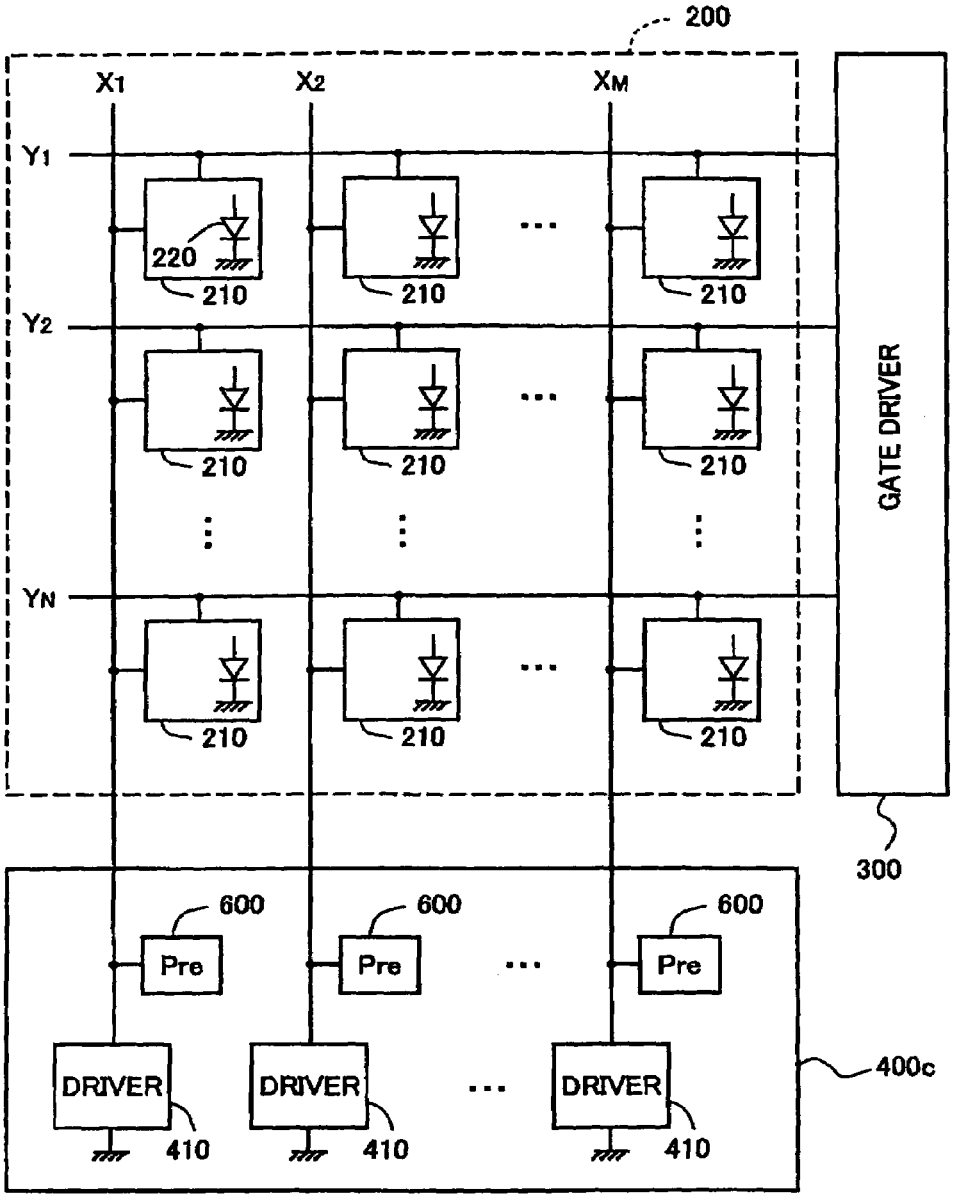
FIG. 23 is a block diagram which illustrates a modification of the layout of the pre-charging circuit.

In cases where the pre-charging circuits 600 are installed within the display matrix section 200 as in the examples shown in FIGS. 22 and 24, the pre-charging circuits 600 are also constructed from TFTs similar to those of the pixel circuits. On the other hand, in cases where the pre-charging circuits 600 are installed outside the display matrix section 200, for example, the pre-charging circuits 600 can be constructed from TFTs inside a display panel that contains the display matrix section 200, or pre-charging circuits 600 can be formed inside an IC that is separate from the display matrix section 200.

Figure 26:
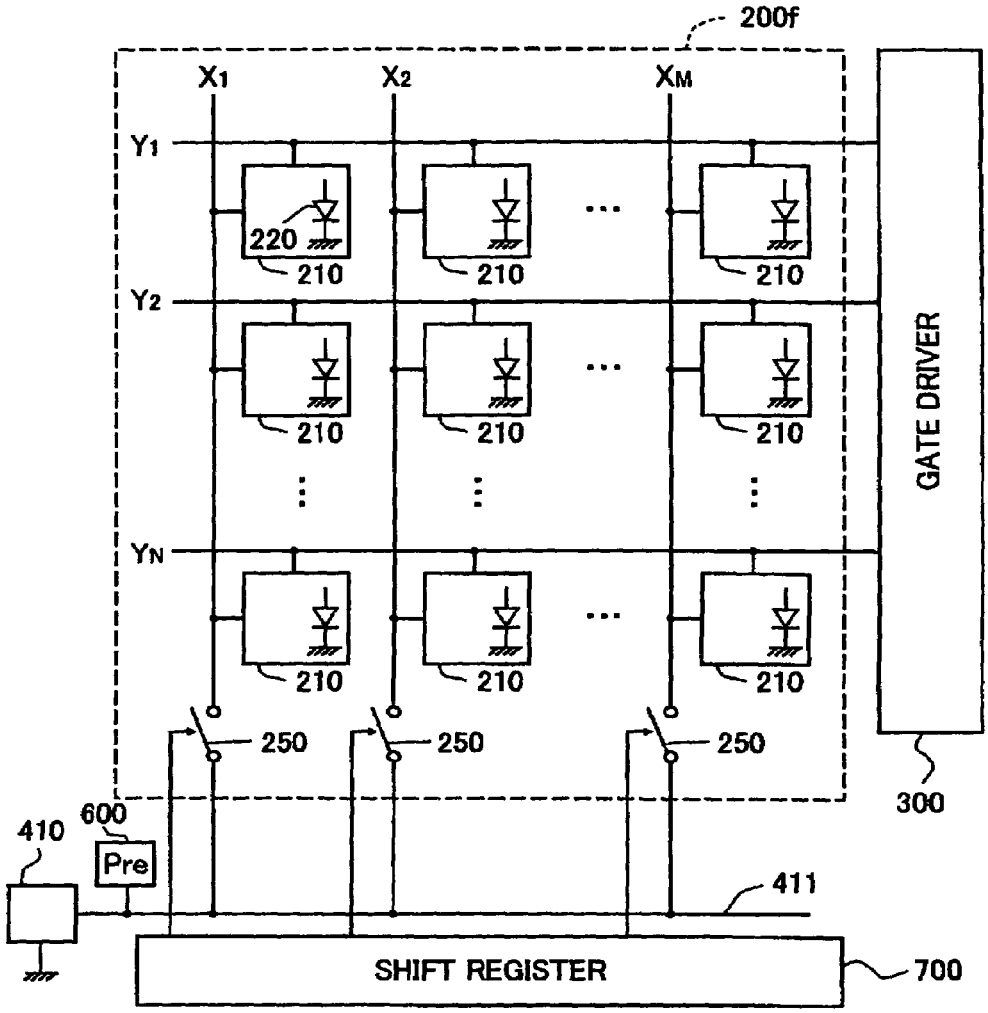
FIG. 26 is a block diagram which illustrates a modification of the layout of the pre-charging circuit.

FIG. 26 shows an example of another display device equipped with a pre-charging circuit 600. In this display device, instead of the plurality of single-line drivers 410 and plurality of pre-charging circuits 600 used in the structure shown in FIG. 23, a single single-line driver 410, a single pre-charging circuit 600 and a shift register 700 are installed. Furthermore, switching transistors 250 are installed for each data line of the display matrix section 200*f*. One terminal of each switching transistor 250 is connected to the corresponding data line Xm, and the other terminal is connected in common to the output signal line 411 of the single-line driver 410. The pre-charging circuit 600 is also connected to this output signal line 411. The shift register 700 supplies on/off control signals to the switching transistors 250 of the respective data lines Xm; as a result, the data lines Xm are successively selected one at a time.

In this display device, the pixel circuits 210 are updated in point succession. Specifically, only one pixel circuit 210, which is located at the intersection point of one gate line Yn selected by the gate driver 300 and one data line Xm selected by the shift register 700, is updated in a single programming pass. For example, M pixel circuits 210 on the n-th gate line Yn are successively programmed one at a time; then, after this programming is completed, the M pixel circuits 10 on the next (n+1)th gate line are programmed one at a time. In contrast, in the respective embodiments and modifications described above, the operation differs from that of the display device shown in FIG. 26 in that one row of pixel circuits are programmed at the same time (i.e., in line succession).

In cases where programming of the pixel circuits is performed in point succession in the manner of the display device shown in FIG. 26, as in the case of the above mentioned fourth embodiment, correct programming of the pixel circuits 210 can be accomplished by pre-charging the data lines prior to the completion of the programming of the respective pixel circuits, or, the speed of the driving control of the organic EL elements 220 can be increased by shortening the programming time.

A feature that the device shown in FIG. 26 shares with the above mentioned embodiments and modifications is that the pre-charging circuit 600 can accelerate the charging or discharging of a plurality of data lines Xm (m=1 through M). However, the pre-charging circuit 600 shown in FIG. 26 does not charge or discharge a plurality of data lines simultaneously; instead, this pre-charging circuit 600 can only charge or discharge the data lines one at a time. As may be seen from this description, the expression "can accelerate the charging or discharging of a plurality of data lines" as used in the present specification does not refer only to cases in which the circuit can accelerate the charging or discharging of a plurality of data lines simultaneously, but also includes cases in which the circuit can accelerate the charging or discharging of a plurality of data lines one at a time in succession.

In the example of FIG. 26, the pre-charging of data lines is performed in a display device in which programming is performed in point succession. However, the above mentioned additional current generation circuit may also be utilized as a means for accelerating the charging or discharging of the data lines in such a device. For example, the single-line driver 410 shown in FIG. 26 has the circuit structure shown in FIG. 6; accordingly, an additional current Ip can be generated using the additional current generation circuit 430. However, there is no need to construct the circuit so that both pre-charging and an additional current can be simultaneously utilized; a circuit structure that allows the utilization of one or the other is sufficient.

H. Examples of Application to Electronic Equipment

The above mentioned display devices utilizing organic EL elements can be applied to various types of electronic equipment such as mobile personal computers, cellular phones, and digital still cameras.

Figure 27:
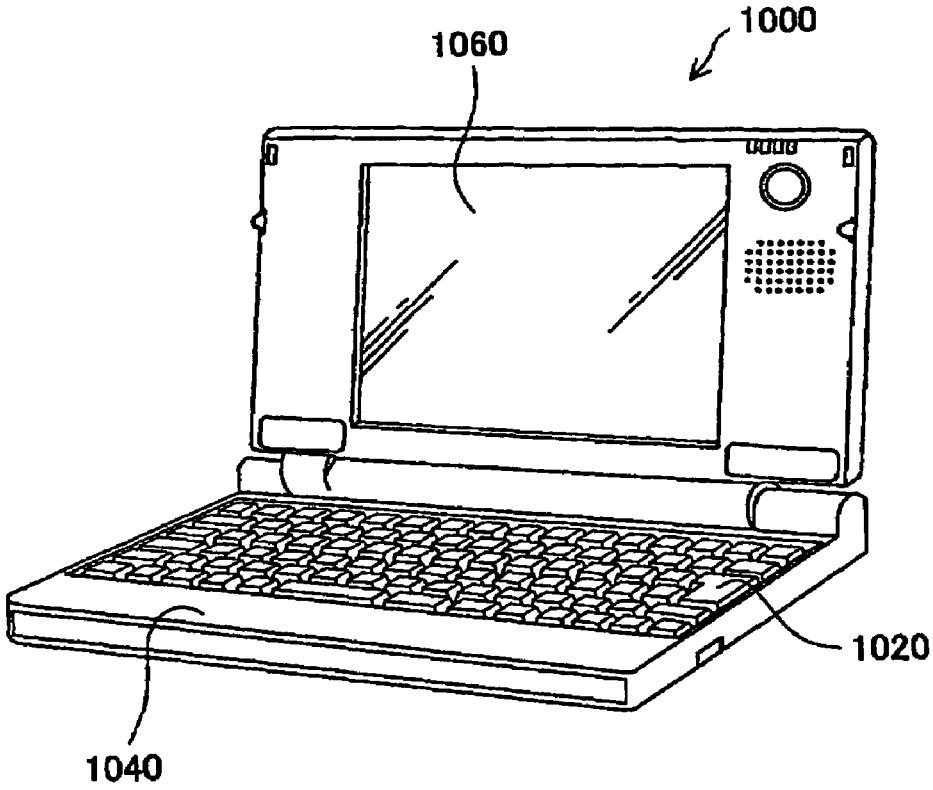
FIG. 27 is a perspective view which shows the structure of a personal computer as one example of electronic equipment to which the display device of the present invention is applied.

FIG. 27 is a perspective view of a mobile type personal computer. The personal computer 1000 is equipped with a main body 104 that has a keyboard 1010, and a display unit 1060 that uses organic EL elements.

Figure 28:
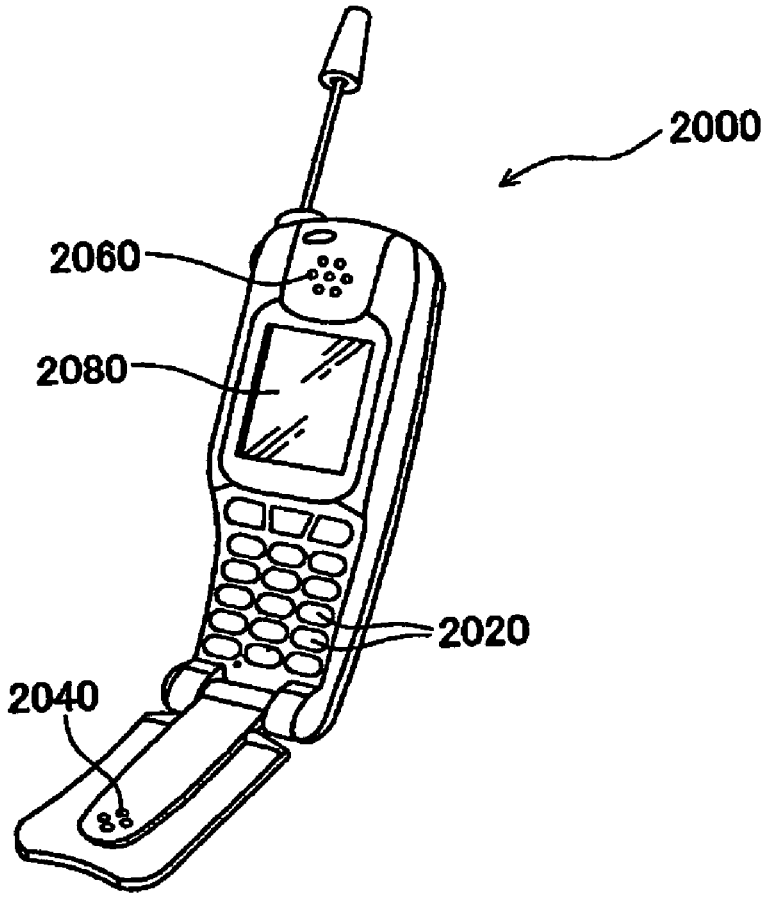
FIG. 28 is a perspective view which shows the structure of a cellular phone as one example of electronic equipment to which the display device of the present invention is applied.

FIG. 28 is a perspective view of a cellular phone. This cellular phone 2000 is equipped with a plurality of operating buttons 2020, a receiver 2040, a transmitter 2060, and a display panel 2080 using organic EL elements.

Figure 29:
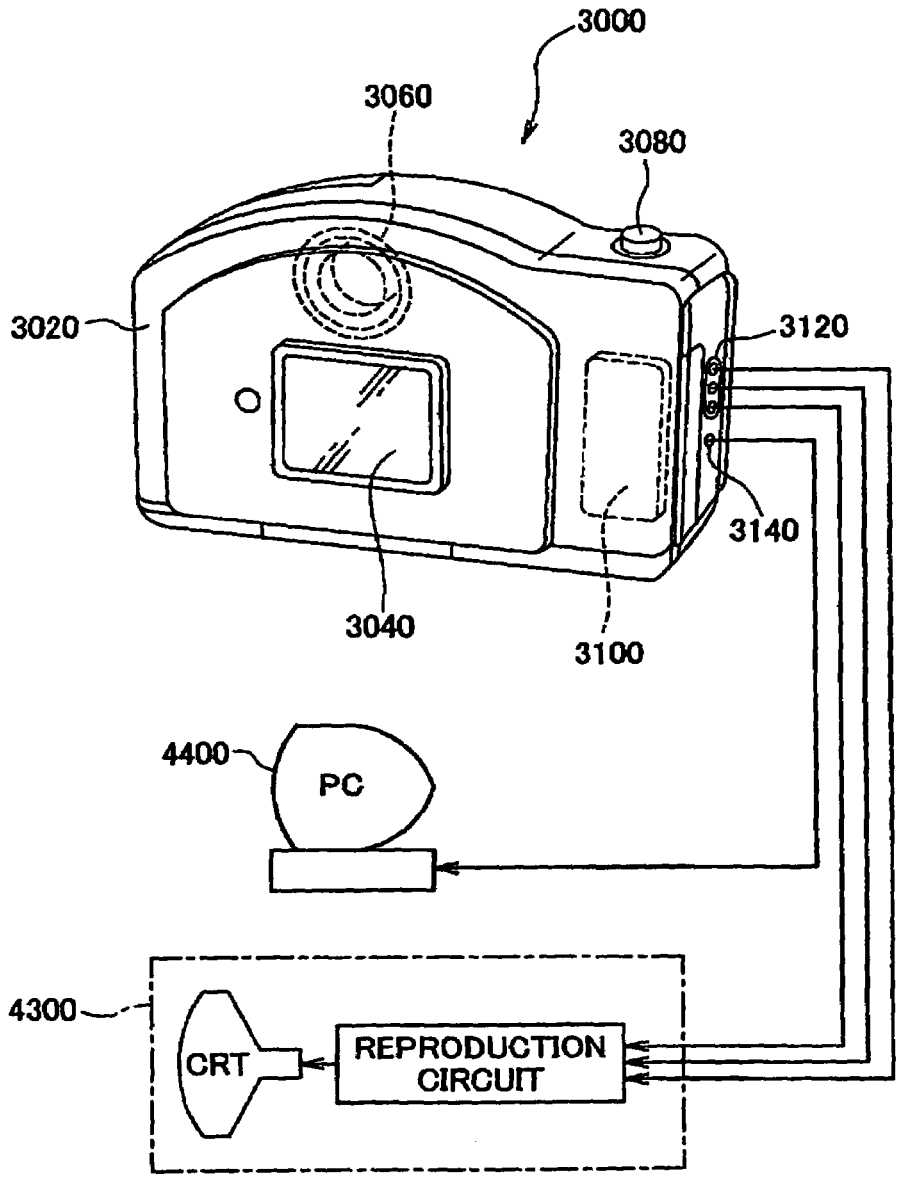
FIG. 29 is a perspective view which shows the structure of the back side of a digital still camera as one example of electronic equipment to which the display device of the present invention is applied.

FIG. 29 is a perspective view of a digital still camera 3000. The connections with external devices are shown in simplified form. While an ordinary camera exposes a film by means of a light image of the object of imaging, this digital still camera 3000 generates an imaging signal by the photo-electric conversion of a light image of the object of imaging by means of an imaging element such as a CCD (charge-coupled device). Here, a display panel 3040 using organic EL elements is disposed on the back of the case 3020 of the digital still camera 3000, and a display is performed on the basis of imaging signals from the CCD. Accordingly, the display panel 3040 functions as a finder that displays the object of imaging. Furthermore, a light-receiving unit 3060 that includes an optical lens and a CCD is disposed on the observation side (back surface side in the figure) of the case 3020.

Here, when the photographer presses the shutter button 3080 while observing an image of the object of imaging displayed on the display panel 3040, the imaging signal of the CCD at this point in time is transferred and stored in the memory of a circuit board 3100. Furthermore, in this digital still camera, a video signal output terminal 3120 and data communications input-output terminal 3140 are disposed on the side surface of the case 3020. Furthermore, as is shown in the figure, a television monitor 4300 is connected to the video signal output terminal 3120, and a personal computer 4400 is connected to the data communications input-output terminal 3140, if necessary. Moreover, imaging signals stored in the memory of the circuit board 3100 are output to the television monitor 4300 or personal computer 4400 by specific operations.

Examples of electronic devices other than the personal computer shown in FIG. 27, cellular phone shown in FIG. 28 and digital still camera shown in FIG. 29 includes television sets, view finder type and monitor direct viewing type video tape recorders, car navigation devices, pagers, electronic notebooks, desktop calculators, word processors, work stations, television telephones, POS terminals, and devices with a touch panel. The above mentioned display devices using organic EL elements may be used as a display section in these various types of electronic equipment.

I. Other Modifications

Modification I1:

Although all of the transistors are constructed from FETs in the various embodiments and modifications described above, some or all of the transistors may be replaced by bipolar transistors or other types of switching elements. The gate electrodes of FETs and the base electrodes of bipolar transistors correspond to the "control electrodes" in the present invention. In addition to thin-film transistors (TFTs), silicon base transistors may also be used as these various types of transistors.

Modification I2:

In the various embodiments and modifications described above, the display matrix section 200 had a single matrix of pixel circuits; however, the display matrix section 200 may also have plural matrices of pixel circuits. For example, in cases where a large panel is constructed, the system may be devised so that the display matrix section 200 is divided into a plurality of adjacent regions, and one pixel circuit matrix is installed for each region. Furthermore, three pixel circuit matrices corresponding to the three colors R, G and B may be installed inside one display matrix section 200. In cases where a plurality of pixel circuit matrices (a plurality of unit circuit matrices) are present, the above mentioned embodiments or modifications can be applied to each matrix.

Modification I3:

In the pixel circuits used in the various embodiments and modifications described above, the programming period Tpr and light emission period Tel are separated as shown in FIGS. 5(*a*)-5(*d*). However, it is also possible to use pixel circuits in which the programming period Tpr is present within a portion of the light emission period. In the case of such pixel circuits, programming of the light emission level is performed in the initial stage of the light emission period Tel; afterward, the light emission continues at the same level. In a device using such pixel circuits as well, correct light emission levels can be set in the pixel circuits by accelerating the charging or discharging of the data lines by an additional current or pre-charging. The programming period can be shortened instead so that the speed of the driving control of the organic EL elements can be increased.

Modification I4:

Although the various embodiments and modifications described above are related to display devices with current-programmable pixel circuits, the present invention can also be applied to display devices that have voltage-programmable pixel circuits. In the case of voltage-programmable pixel circuits, programming (setting of light emission levels) is performed in accordance with the voltage levels of the data lines. Acceleration of the charging or discharging of the data lines utilizing an additional current or pre-charging can also be performed in a display device that has voltage-programmable pixel circuits.

However, in the case of display devices that use current-programmable pixel circuits, the programming current value is extremely small when the light emission level is low; consequently, there is a possibility that considerable time will be required for programming. Accordingly, the effect of accelerating the charging or discharging of the data lines is more prominent in cases where the present invention is applied to display devices that use current-programmable pixel circuits.

Modification I5:

In the various embodiments and modifications described above, the emission levels of the light emitted by the organic EL elements are adjustable; however, the present invention can also be applied to display devices in which, for example, a black and white display (two-way display) is performed by generating a constant current. Furthermore, the present invention can also be used in cases where organic EL elements are driven using a passive matrix driving method. However, in the case of display devices in which multi-level adjustment is possible, and display devices using an active matrix driving method, the requirements for increased speed of driving are stronger; accordingly, the effect of the present invention is more prominent in the case of such display devices. Furthermore, the present invention is not limited to display devices in which the pixel circuits are arranged in the form of a matrix; the present invention can also be used in cases where other arrangements are employed.

Modifications I6:

Although the embodiments and modifications described above are directed to display devices using organic EL elements, the present invention can also be applied to display devices and electronic devices using light-emitting elements other than organic EL elements. For example, the present invention can also be applied to devices that have other types of light-emitting elements, such as LEDs and FEDs (field emission displays) in which the light emission level can be adjusted in accordance with the driving current value.

Figure 30:
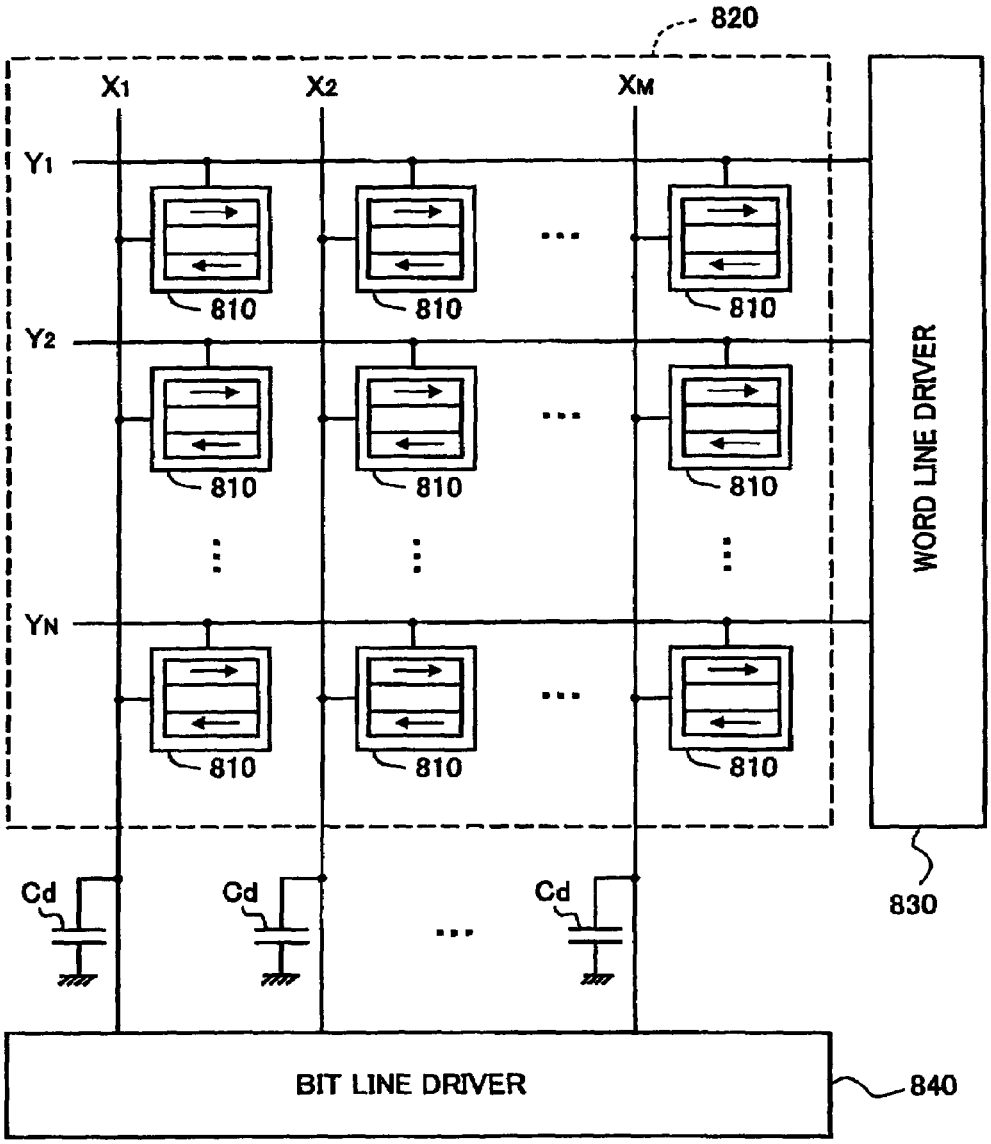
FIG. 30 is a block diagram which shows the structure of a magnetic RAM device as another embodiment of the present invention.

Modification I7:

The present invention can also be applied to other current-driven elements other than light-emitting elements. Examples of such current-driven elements include magnetic RAM (MRAM). FIG. 30 is a block diagram showing the structure of a memory device utilizing magnetic RAM.

This memory device has a memory cell matrix section 820, a word line driver 830, and a bit line driver 840. The memory cell matrix section 820 has a plurality of magnetic memory cells 810 that are arranged in the form of a matrix. A plurality of bit lines X1, X2 . . . that extend along the column direction, and a plurality of word lines Y1, Y2 . . . that extend along the row direction, are respectively connected to the matrix of the magnetic memory cells 810. As may be seen from a comparison of this FIG. 30 with FIG. 3 of the first embodiment, the memory cell matrix section 810 corresponds to the display matrix section 200. Furthermore, the magnetic memory cells 810 correspond to the pixel circuits 210, the word line driver 830 corresponds to the gate driver 300, and the bit line driver 840 corresponds to the data line driver 400.

Figure 31:
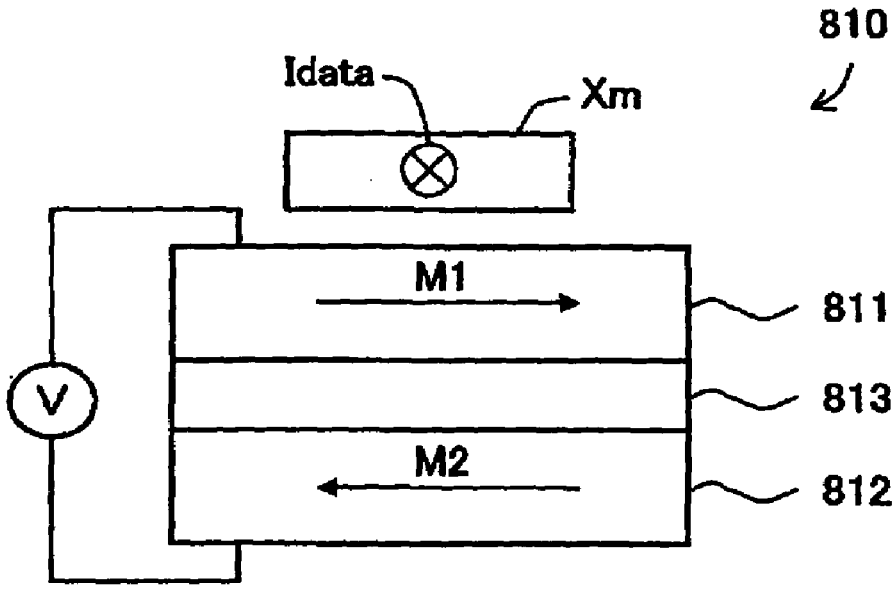
FIG. 31 is an explanatory diagram which shows the schematic structure of a magnetic RAM.

FIG. 31 is an explanatory diagram which shows the structure of one magnetic memory cell 810. This magnetic memory cell 810 has a structure in which a barrier layer 813 made of an insulating material is interposed between two electrodes 811 and 812 made of ferromagnetic metal layers. The magnetic RAM is devised so that data is stored by utilizing the following phenomenon: namely, when a tunnel current is caused to flow between the two electrodes 811 and 812 via the barrier layer 813, the magnitude of this tunnel current depends on the orientations of the magnetizations M1 and M2 of the upper and lower ferromagnetic metals. In concrete terms, the stored data is judged as "0" or "1" by measuring the voltage (or resistance) between the two electrodes 811 and 812.

One electrode 812 is utilized as a reference layer in which the orientation of the magnetization M2 is fixed, while the other electrode 811 is utilized as a data storage layer. For example, the storage of information is accomplished by causing a data current Idata to flow through the bit line Xm (writing electrode), and varying the orientation of the magnetization of the electrode 811 by means of the magnetic field that is generated in accordance with this current. The reading of stored information is accomplished by causing a current to flow in the opposite direction through the bit line Xm (reading electrode), and magnetically reading out the tunnel resistance or voltage.

The memory device illustrated in FIGS. 30 and 31 is one example of a device using such magnetic RAM, and various magnetic RAM structure and methods for recording and reading out information have been proposed.

The present invention can also be applied to electronic devices using current-driven elements that are not light-emitting elements, such as the above mentioned magnetic RAM. Specifically, the present invention can be applied in general to electronic devices using current-driven elements.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electro-optical device which is driven by an active matrix driving method, comprising:

a unit circuit matrix in which a plurality of unit circuits are arranged in the form of a matrix, each unit circuit including a light-emitting element and a circuit for adjusting an emission level of light to be emitted by the light-emitting element;

a plurality of scan lines which are respectively connected to the unit circuits, and which are arranged along a row direction of the unit circuit matrix;

a plurality of data lines which are respectively connected to the unit circuits, and which are arranged along a column direction of the unit circuit matrix;

a scan line driving circuit, connected to the plurality of scan lines, for selecting one row of the unit circuit matrix;

a data signal generating circuit for generating a data signal in accordance with the emission level of the light to be emitted by the light-emitting element, and outputting the data signal onto one data line selected from the plurality of data lines; and a charging/discharging accelerating section which is capable of sequentially selecting one unit circuit from the plurality of unit circuits that is present in the row selected by the scan line driving circuit, and accelerating charging or discharging of a data line through which the data signal is supplied to the selected unit circuit, wherein the light-emitting elements are current-driven type elements in which the light emission level depends on a current value flowing through the element, each unit circuit comprises;

a driving transistor having a control electrode, the driving transistor being installed in a path of the current that flows through the light-emitting element, and a storage capacitor, connected to the control electrode of the driving transistor, for setting the current value that flows through the light-emitting element by holding an electric charge that corresponds to an operating state of the driving transistor, and wherein the accumulated charge in the storage capacitor is adjusted by the data signal.

2. An electro-optical device according to claim 1, wherein the charging/discharging accelerating section includes a pre-charging circuit that is capable of pre-charging the plurality of data lines.

3. An electro-optical device according to claim 2, wherein a single unit of the charging/discharging accelerating section is provided for all of the plurality of data lines.

4. An electro-optical device according to claim 2, wherein the pre-charging circuit performs the pre-charging so that the data line is charged or discharged to a voltage corresponding to a low emission range that is equal to or less than a central value of the light emission level.

5. An electro-optical device according to claim 2, wherein the pre-charging circuit performs the pre-charging so that the data line is charged or discharged to a voltage level corresponding to an emission range in the vicinity of a lowest non-zero light emission level.

6. An electro-optical device according to claim 2, wherein the respective unit circuits are provided for each of a plurality of color components, and the pre-charging circuit performs the pre-charging so that the data line is charged or discharged to a different voltage level for each color component.

7. An electro-optical device according to claim 2, further comprising a judgment circuit for judging a need to use the pre-charging circuit based on a voltage of the data line, which is subject to the pre-charging, at the start of the pre-charging of the data line.

8. An electro-optical device according to claim 7, wherein the judgment circuit judges whether or not to perform the pre-charging with respect to each data line.

9. A piece of electronic equipment comprising the electro-optical device according to claim 1.

* * * * *